US011046411B2

(12) United States Patent
Chung et al.

(10) Patent No.: US 11,046,411 B2
(45) Date of Patent: Jun. 29, 2021

(54) TILLER ASSEMBLY FOR A MARINE OUTBOARD ENGINE

(71) Applicant: BRP US INC., Sturtevant, WI (US)

(72) Inventors: Kenneth Chung, Lindenhurst, IL (US); Darrell Wiatrowski, Libertyville, IL (US); Samuel McGinley, Milwaukee, WI (US)

(73) Assignee: BRP US INC.

( * ) Notice: Subject to any disclaimer, the term of this patent is extended or adjusted under 35 U.S.C. 154(b) by 6 days.

(21) Appl. No.: 16/699,035

(22) Filed: Nov. 28, 2019

(65) Prior Publication Data

US 2020/0172220 A1 Jun. 4, 2020

Related U.S. Application Data

(60) Provisional application No. 62/772,429, filed on Nov. 28, 2018.

(51) Int. Cl.

| | |
|---|---|
| ***B63H 20/12*** | (2006.01) |
| ***B63H 20/00*** | (2006.01) |
| *B63H 21/21* | (2006.01) |

(52) U.S. Cl.

CPC ..... *B63H 21/265* (2013.01); *B63H 20/12* (2013.01); *B63H 21/213* (2013.01)

(58) Field of Classification Search

CPC ..... B63H 21/265; B63H 21/213; B63H 20/12
See application file for complete search history.

(56) References Cited

U.S. PATENT DOCUMENTS

| | | | | |
|---|---|---|---|---|
| 5,632,657 | A | 5/1997 | Henderson | |
| 5,797,777 | A * | 8/1998 | Tsunekawa | B63H 21/265 440/84 |
| 6,093,066 | A | 7/2000 | Isogawa et al. | |
| 6,406,342 | B1 | 6/2002 | Walczak et al. | |
| 6,902,450 | B2 | 6/2005 | Ohtsuki et al. | |
| 7,090,551 | B1 | 8/2006 | Lokken et al. | |

(Continued)

FOREIGN PATENT DOCUMENTS

JP 4218492 A 5/2005

OTHER PUBLICATIONS

English Abstract of JP4218492A; Retrieved on Nov. 28, 2019; Retrieved from www.worldwide.espacenet.com.

(Continued)

*Primary Examiner* — Stephen P Avila
(74) *Attorney, Agent, or Firm* — BCF LLP

(57) ABSTRACT

A tiller assembly includes a base and a tiller arm pivotably connected to the base. One of the base and the tiller arm defines a recess. The recess is at least partially defined by a female tapered surface. A shaft extends through the base and the tiller arm and has a first threaded portion. A clamping fitting is connected to the shaft and received in the recess. The clamping fitting is rotationally fixed relative to another one of the base and the tiller arm and has a male tapered surface. One of a handle and the clamping fitting has a second threaded portion engaged with the first threaded portion. Rotation of the first threaded portion relative to the second threaded portion in a pre-determined direction causes the male tapered surface to press against the female tapered surface. A marine outboard engine and a tiller assembly kit are also provided.

21 Claims, 13 Drawing Sheets

(56) References Cited

U.S. PATENT DOCUMENTS

| | | | | |
|---|---|---|---|---|
| 7,214,113 | B2 | 5/2007 | Kojima | |
| 7,442,104 | B2 | 10/2008 | Okabe | |
| 7,677,938 | B2 | 3/2010 | Wiatrowski et al. | |
| 7,704,110 | B2 | 4/2010 | Wiatrowski et al. | |
| 9,789,945 | B1 | 10/2017 | Vaninetti et al. | |
| 2004/0121667 | A1* | 6/2004 | Okabe | B63H 20/12 440/87 |
| 2009/0075534 | A1* | 3/2009 | Wiatrowski | B63H 20/12 440/53 |
| 2018/0354596 | A1* | 12/2018 | Matsuyama | B63H 21/265 |

OTHER PUBLICATIONS

Screen captures from YouTube video clip entitled "Multi-Function Tiller Handle for 15-20 HP Outboards" 5 pages, uploaded on Nov. 14, 2017 by "Mercury Marine EMEA". Retrieved from Internet: <https://www.youtube.com/watch?v=d5fMEghBY1s&feature=youtu.be&t=79>.

Bombardier Recreational Products "Part Catalogs". 2018.

* cited by examiner

TILLER ASSEMBLY FOR A MARINE OUTBOARD ENGINE

CROSS-REFERENCE

The present application claims priority to U.S. Provisional Patent Application No. 62/772,429, filed Nov. 28, 2018, the entirety of which is incorporated herein by reference.

TECHNICAL FIELD

The present technology relates to tiller assemblies for marine outboard engines.

BACKGROUND

Some marine outboard engines are provided with a tiller arm with which the marine outboard engine is steerable. At least some tiller arms are pivotable about a horizontal axis with respect to the marine outboard engine so as to allow the tiller arm to be raised or lowered to a comfortable height for the driver. This tiller arm adjustment is typically independent of the marine outboard engine's steering with respect to the swivel bracket about a vertical steering axis and independent of the marine outboard engine's tilting/trimming with respect to the stern bracket about a horizontal tilt-trim axis. Various mechanisms exist for setting and keeping a tiller arm at a desired angle with respect to the marine outboard engine.

For example, it is common to use a bolt that extends through the tiller arm and tiller arm base as an axle about which the tiller arm pivots. Tightening a nut at the end of the bolt creates sufficient friction in the tiller assembly to lock the tiller arm at the desired angle. A downside of such a conventional bolted tiller assembly is that the clamping force provided by the bolt is effectively all-or-nothing in that it is challenging, and at least in some cases impossible, to manually tighten the bolt just enough to resist gravity and the normal shocks, loads and vibrations to which a tiller arm may be subjected to when the watercraft to which it is mounted is underway, while remaining repositionable manually.

Also, such bolted tiller assemblies typically require tools to tighten/untighten the bolt, making changing the locked position of the tiller arm inconvenient.

Other, more easily adjustable tiller assemblies exist. Some such tiller assemblies use a spring loaded positive locking mechanism with a retractable spring-loaded pin (or a similar element) on one of the tiller arm and the base to selectively engage one of a plurality of recesses on the other of the tiller arm and the base to lock the tiller arm in one of a plurality of a given number of pre-defined angular positions. Such systems are adjustable without tools but provide a limited number of possible tiller arm positions.

It is also known to provide an adjustable stopper on a base beneath the tiller arm that sets a lower position of the tiller arm. In such prior art tiller assemblies, the tiller arm remains loose (not locked) during operation, and rests on the stopper. The stopper can be raised or lowered to set the lower position of the tiller arm. However, in at least some cases, adjusting the position of the stopper can be awkward when the outboard marine engine is in use.

In summary, prior art tiller assemblies are suitable for their intended purposes. However, there remains a need for a tiller assembly that enables convenient positioning and repositioning of the tiller arm before, during and after use.

SUMMARY

It is an object of the present technology to ameliorate at least some of the inconveniences present in the prior art.

According to one aspect of the present technology, there is provided a tiller assembly for a marine outboard engine. The tiller assembly includes a base adapted to pivot relative to a steering axis of the marine outboard engine and defining an axis of rotation that is perpendicular to the steering axis, and a tiller arm pivotably connected to the base to pivot relative to the base about the axis of rotation for adjusting an angular position of the tiller arm relative to the base. One of the base and the tiller arm defines a recess. The recess is coaxial with the axis of rotation and is at least partially defined by a female tapered surface.

The tiller assembly further includes a shaft extending through the base and the tiller arm. The shaft extends through the recess, defines the axis of rotation, and has a first threaded portion. The tiller assembly yet further includes a clamping fitting and a handle. The clamping fitting is connected to the shaft and received at least in part in the recess. The clamping fitting is rotationally fixed relative to another one of the base and the tiller arm and has a male tapered surface received at least in part in the recess. At least one of the handle and the clamping fitting has a second threaded portion engaged with the first threaded portion. Rotation of the first threaded portion relative to the second threaded portion in a pre-determined direction causes the male tapered surface of the clamping fitting to press against the female tapered surface of the recess.

In some embodiments, the other one of the base and the tiller arm defines a plurality of first splines disposed circumferentially about the axis of rotation, and the clamping fitting has a plurality of second splines engaging the plurality of first splines.

In some embodiments, the tiller assembly further comprises at least one resilient member arranged in compression so as to press the male tapered surface of the clamping fitting against the female tapered surface of the recess.

In some embodiments, the at least one resilient member is arranged in compression between: a) one of the handle and the shaft, and b) one of the base and the tiller arm, so as to push the male tapered surface of the clamping fitting against the female tapered surface of the recess.

In some embodiments, the at least one resilient member is disposed between the handle and the clamping fitting.

In some embodiments, the at least one resilient member includes at least one spring washer defining an axial aperture therein and receiving the shaft through the axial aperture.

In some embodiments, the handle is coaxial with the axis of rotation of the tiller arm.

In some embodiments, the clamping fitting has the second threaded portion; the female tapered surface of the recess faces away from the handle; and the rotation of the first threaded portion relative to the second threaded portion in the pre-determined direction causes the shaft to rotate in the pre-determined direction about the axis of rotation and to thereby press the male tapered surface of the clamping fitting toward the handle against the female tapered surface of the recess.

In some embodiments, the recess has a cylindrical portion and a frusto-conical portion; the cylindrical portion and the frusto-conical portion are coaxial with the axis of rotation; and the frusto-conical portion extends and narrows from the cylindrical portion toward the handle.

In some embodiments, the recess is a first recess defined in a portion of the base; the clamping fitting is a first clamping fitting; the base defines a second recess in the portion of the base opposite the first recess, the second recess having a cylindrical portion and a female tapered surface that are coaxial with the axis of rotation, the female tapered surface of the second recess extending and narrowing from the cylindrical portion of the second recess toward the first recess; the tiller arm defines the plurality of first splines and a plurality of third splines disposed circumferentially about the axis of rotation; and the tiller assembly further includes a second clamping fitting, the second clamping fitting slidably engaging the shaft and comprising a male tapered surface and a plurality of fourth splines disposed circumferentially about the axis of rotation, the second clamping fitting being received at least in part in the second recess, the male tapered surface of the second clamping fitting pressing against the female tapered surface of the second recess, the plurality of fourth splines of the second clamping fitting engaging the plurality of third splines of the tiller arm.

In some embodiments, the tiller arm defines a first arm at a rear end of the tiller arm, the first arm defining a first aperture coaxially with the axis of rotation, the first aperture comprising the plurality of first splines therein; the tiller arm defines a second arm at the rear end of the tiller arm, the second arm defining a second aperture coaxially with the axis of rotation, the second aperture comprising the plurality of third splines therein; the first and second clamping fittings are slidable relative to the tiller arm along the axis of rotation and are rotationally fixed relative to the tiller arm; and the portion of the base defining the first and second recesses therein is received between the first arm and the second arm.

In some embodiments, the second clamping fitting is disposed between the first clamping fitting and the handle; the tiller assembly further includes at least one resilient member disposed between the handle and the second clamping fitting; and the handle presses the at least one resilient member against the second clamping fitting.

In some embodiments, the at least one resilient member includes at least one spring washer defining an axial aperture therein and receiving the shaft through the axial aperture.

In some embodiments, the handle has the second threaded portion; the clamping fitting is rotationally fixed relative to the shaft; and the handle is rotatable relative to the shaft in the pre-determined direction, the handle rotating relative to the shaft in the pre-determined direction causing the first threaded portion to operate against the second threaded portion to thereby press the handle against the resilient member, the resilient member thereby pressing against the second clamping fitting.

In some embodiments, the male tapered surface of the clamping fitting and the female tapered surface of the recess each have a smooth frusto-conical surface.

In some embodiments, the frusto-conical surfaces of the clamping fitting and the recess define an angle with the axis of rotation, the angle being between 7 degrees and 45 degrees.

In some embodiments, the angle is between 14 and 16 degrees.

In some embodiments, the angle is approximately 15 degrees.

In some embodiments, the tiller arm has a longitudinal axis and the axis of rotation is perpendicular to both the longitudinal axis and the steering axis.

In another aspect, the present technology provides a marine outboard engine. In some embodiments, the marine outboard engine includes: a stern bracket attachable to a watercraft; a swivel bracket pivotably connected to the stern bracket to pivot relative to the stern bracket about a tilt/trim axis; a drive unit pivotably connected to the swivel bracket for pivoting with the swivel bracket about the tilt/trim axis and for pivoting relative to the swivel bracket about the steering axis; and the tiller assembly as described herein above. In some such embodiments, the base of the tiller assembly is attached to the drive unit for pivoting the drive unit about the steering axis.

In yet another aspect, the present technology provides a tiller assembly kit for a marine outboard engine. In some embodiments, the tiller assembly kit includes: a base for being connected to the marine outboard engine to pivot relative to a steering axis of the marine outboard engine, the base defining an axis of rotation that is perpendicular to the steering axis when the base is connected to the marine outboard engine; and a tiller arm for being pivotably connected to the base to pivot relative to the base about an axis of rotation for adjusting an angular position of the tiller arm relative to the base, the axis of rotation being perpendicular to the steering axis when the tiller assembly kit is assembled and attached to the marine outboard engine.

In some embodiments, one of the base and the tiller arm defines a recess, the recess being coaxial with the axis of rotation when the tiller assembly kit is assembled and being at least partially defined by a female tapered surface.

In some embodiments, the tiller assembly kit further includes: a shaft for being received through the base and the tiller arm and for extending through the recess, the shaft having a first threaded portion; a clamping fitting for being connected to the shaft and for being received at least in part in the recess, the clamping fitting being adapted to be rotationally fixed relative to another one of the base and the tiller arm when the tiller assembly kit is assembled, the clamping fitting having a male tapered surface shaped to be received at least in part in the recess when the tiller assembly kit is assembled; and a handle adapted to be connected to the shaft, at least one of the handle and the clamping fitting having a second threaded portion, wherein when the tiller assembly kit is assembled, rotation of the first threaded portion relative to the second threaded portion in a pre-determined direction causes the male tapered surface of the clamping fitting to press against the female tapered surface of the recess.

In some embodiments, the handle, the female tapered surface, and the male tapered surface are adapted to be coaxial with the axis of rotation of the tiller arm when the tiller assembly kit is assembled.

In some embodiments of the tiller assembly kit: the other one of the base and the tiller arm defines a plurality of first splines disposed circumferentially about the axis of rotation; the clamping fitting has the second threaded portion and a plurality of second splines engaging the plurality of first splines; the female tapered surface of the recess is oriented to face away from the handle when the tiller assembly kit is assembled; and the handle is adapted for, when the tiller assembly kit is assembled, rotating the shaft in the pre-determined direction about the axis of rotation to thereby press the male tapered surface against the female tapered surface.

In some embodiments of the tiller assembly kit: the recess is a first recess defined in a portion of the base, the first recess having a cylindrical portion and a female frusto-conical portion, the cylindrical portion and the female frusto-conical portion being coaxial with the axis of rotation and the female frusto-conical portion extending and narrowing from the cylindrical portion toward the handle when the tiller assembly kit is assembled; the clamping fitting is a first clamping fitting, the first clamping fitting having a plurality of first splines disposed circumferentially about the axis of rotation when the tiller assembly kit is assembled; and the base defines a second recess in the portion of the base opposite the first recess, the second recess having a cylindrical portion and a female frusto-conical portion, the cylindrical portion and the female frusto-conical portion of the second recess being coaxial with the axis of rotation and the female frusto-conical portion of the second recess extending and narrowing from the cylindrical portion of the second recess toward the first recess when the tiller assembly kit is assembled.

In some such embodiments, the tiller assembly kit further includes a second clamping fitting, the second clamping fitting being for slidably engaging the shaft and comprising a male tapered surface and a plurality of second splines, the male tapered surface of the second clamping fitting being shaped to be received at least in part in the second recess when the tiller assembly kit is assembled. In some such embodiments, the tiller arm defines: a plurality of third splines for engaging the plurality of first splines of the first clamping fitting when the tiller assembly kit is assembled, and a plurality of fourth splines for engaging the plurality of second splines of the second clamping fitting when the tiller assembly kit is assembled.

In some embodiments, the tiller arm defines a first arm at a rear end of the tiller arm, the first arm defining a first aperture coaxial with the axis of rotation when the tiller assembly kit is assembled, the first aperture comprising the plurality of third splines therein; the tiller arm defines a second arm at the rear end of the tiller arm, the second arm defining a second aperture coaxial with the axis of rotation when the tiller assembly kit is assembled, the second aperture comprising the plurality of fourth splines therein; the first and second clamping fittings are shaped to be received at least in part in respective ones of the first and second apertures so as to be slidable relative to the tiller arm along the axis of rotation and to be rotationally fixed relative to the tiller arm; and the portion of the base defining the first and second recesses therein is shaped to be received between the first arm and the second arm when the tiller assembly kit is assembled.

In yet another aspect of the present technology, there is provided another tiller assembly for a marine outboard engine. In some embodiments thereof, the other tiller assembly includes: a base adapted to pivot relative to a steering axis of the marine outboard engine and defining an axis of rotation that is perpendicular to the steering axis; a tiller arm pivotably connected to the base to pivot relative to the base about the axis of rotation for adjusting an angular position of the tiller arm relative to the base, one of the base and the tiller arm defining a male tapered surface, the male tapered surface being coaxial with the axis of rotation; a shaft extending through the base and the tiller arm, the shaft being coaxial with the axis of rotation, the shaft having a first threaded portion; a clamping fitting connected to the shaft, the clamping fitting defining a female tapered surface, the female tapered surface being coaxial with the axis of rotation, the female tapered surface contacting the male tapered surface, the clamping fitting being rotationally fixed relative to another one of the base and the tiller arm; and a handle, at least one of the handle and the clamping fitting having a second threaded portion engaged with the first threaded portion.

In some such embodiments, rotation of the first threaded portion relative to the second threaded portion in a predetermined direction causes the female tapered surface of the clamping fitting to press against the male tapered surface.

The foregoing examples are non-limiting.

For purposes of this application, terms related to spatial orientation such as forward, rearward, upward, downward, left, and right, should be understood in a frame of reference where the propeller position corresponds to a rear of the marine outboard engine. Terms related to spatial orientation when describing or referring to components or sub-assemblies of the engine separately from the engine should be understood as they would be understood when these components or sub-assemblies are mounted to the engine, unless specified otherwise in this application.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
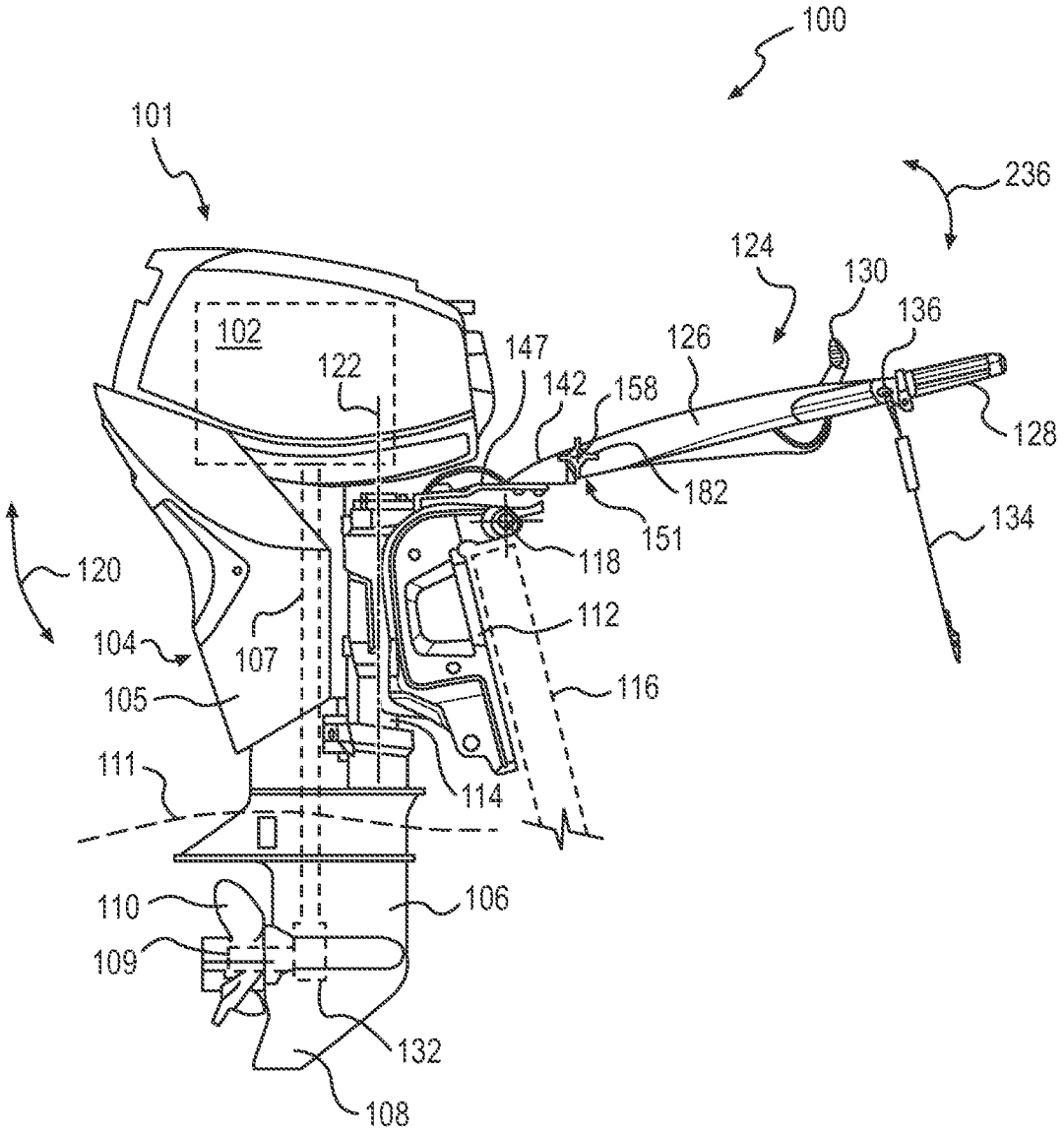
FIG. 1 is a right side elevation view of a marine outboard engine.

Referring to FIG. 1, a marine outboard engine 100 includes a drive unit 101 for powering and propelling the marine outboard engine 100. The drive unit 101 includes a motor 102, a mid-section 104, a gear case 106, and a propeller 110. The motor 102 is an internal combustion engine, but could also be any other type of motor. In some embodiments, the motor 102 could be an electric motor for example.

The mid-section 104 extends downward from the motor 102 to the gear case 106. The mid-section 104 houses vertical exhaust conduits 105 at a rear portion thereof, and a vertical drive shaft 107 at a front portion thereof. The vertical exhaust conduits 105 direct exhaust from the motor 102 into a body of water 111 in which the marine outboard engine 100 is used. The vertical drive shaft 107 connects a crankshaft (not shown) of the motor 102 to a transmission 132 disposed in the gear case 106.

The gear case 106 includes a skeg 108 and a propeller shaft 109 connected at a front end thereof to the transmission 132. The rear end of the propeller shaft 109 extends rearward out of the gear case 106. The propeller 110 is mounted onto the rear end of the propeller shaft 109 for propelling the marine outboard engine 100 through a body of water 111. In the present embodiment, the transmission 132 is a mechanical outboard transmission that is operable by a shift lever 130. It is contemplated that the transmission 132 could be operated by a different mechanism. It is contemplated that the marine outboard engine 100 could have any other transmission.

In the present embodiment, a stern bracket 112 and a swivel bracket 114 are used to mount the drive unit 101, and the marine outboard engine 100, to a watercraft. More particularly, the stern bracket 112 is attachable to a stern 116 of the watercraft and can take various forms, the details of which are conventionally known. The swivel bracket 114 is pivotably connected to the stem bracket 112 to pivot relative to the stern bracket 112 about a horizontal tilt-trim axis 118, as shown with a double-ended arrow 120 in FIG. 1. This allows for changes in the tilt/trim of the marine outboard engine 100. It is contemplated that any tilt-trim mechanism could be used for the tilt/trim adjustment of the marine outboard engine 100. It is also contemplated that the marine outboard engine 100 could have no tilt-trim mechanism.

The drive unit 101 of the marine outboard engine 100 is pivotably connected to the swivel bracket 114 to pivot about a steering axis 122. This allows for steering of the marine outboard engine 100 and the watercraft to which it is attached. It is contemplated that any other mechanism could be used for mounting the marine outboard engine 100 onto a watercraft.

Still referring to FIG. 1, the marine outboard engine 100 further includes a tiller assembly 124. The tiller assembly 124 includes a base 142, a tiller arm 126, and a tiller hinge mechanism 151.

In the present embodiment, the base 142 is connected to the drive unit 101 to pivot with the drive unit 101 about the steering axis 122. The base 142 is made of aluminum, but other materials are contemplated. In the present embodiment, the base 142 is bolted to an upper motor mount 147 of the drive unit 101 to transfer torque applied manually to the tiller arm 126 to the drive unit 101 to pivot the drive unit 101 about the steering axis 122. It is contemplated that the base 142 could be connected to the drive unit 101 via any other suitable means.

Figure 2:
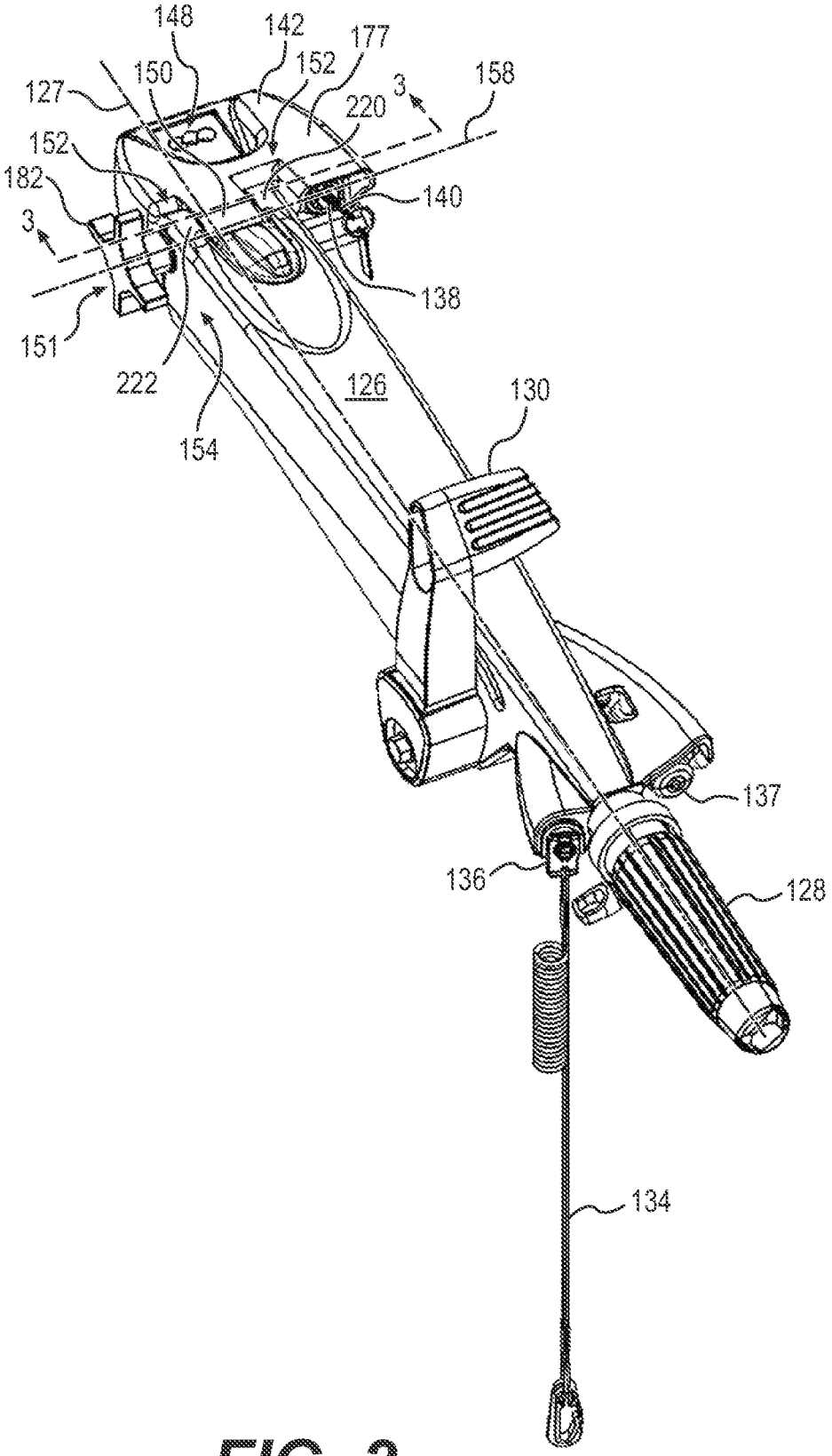
FIG. 2 is a perspective view of a tiller assembly of the marine outboard engine of FIG. 1, taken from a front, right, top view thereof.

With additional reference to FIG. 2, the tiller hinge mechanism 151 pivotably connects the tiller arm 126 to the base 142 to pivot relative to the base 142 about a horizontal axis of rotation 158. The tiller hinge mechanism 151 allows a user to adjust the pivoting resistance of the tiller arm 126 relative to the base 142. To this end, the tiller hinge mechanism 151 has a handle 182 that is manually rotatable to various positions relative to the tiller arm 126. By changing the position of the handle 182, the user may adjust the pivoting resistance of the tiller arm 126.

In the present embodiment, the handle 182 of the tiller hinge mechanism 151 can be manually rotated to at least one position in which the tiller hinge mechanism 151 provides all of the following: a) allows the tiller arm 126 to be manually pivoted relative to the base 142 about an axis of rotation 158, to a given angular position, b) keeps the tiller arm 126 in the given angular position when no manual force is applied to the tiller arm 126, c) allows the tiller arm 126 to be again manually pivoted about the axis of rotation 158 to another given angular position; and d) keeps the tiller arm 126 in the other given angular position when no manual force is applied to the tiller arm 126, until the tiller arm 126 is again manually pivoted to yet another given angular position. A user of the marine outboard engine 100 can adjust the pivoting resistance according to the user's strength and the operating conditions encountered at a given time, for example depending on whether the watercraft is operating in rough or flat waters, and can carry out all of a) to d) above without having to readjust the position of the handle 182 of the tiller hinge mechanism 151.

The tiller arm 126 extends forward from the base 142 along a longitudinal axis 127. The axis of rotation 158 is perpendicular to both the longitudinal axis 127 of the tiller arm 126 and the steering axis 122 of the marine outboard engine 100. The tiller arm 126 allows a user to manually steer the marine outboard engine 100. The tiller arm 126 includes a throttle grip 128 in the form of a twist grip used as throttle control as in many conventional marine outboard engines. The tiller arm 126 also includes the shift lever 130 for selecting a forward, neutral or reverse gear of the transmission 132 housed in the gear case 106. The tiller arm 126 further includes a safety lanyard 134 connected to an engine cut-off switch 136, an engine start/stop switch 137 and a key switch 138 operable with a key 140 to wake the electrical system of the outboard engine 100. These elements are conventional and are therefore not described in more detail herein. It is contemplated that these elements could be different and/or omitted.

Referring to FIG. 2, the tiller arm 126 connects to the base 142 via a pair of arms 220 and 222 defined at a rear end 154 of the tiller arm 126. The portion of the tiller arm 126 that forms the arms 220 is made of aluminum, but other materials are contemplated. The base 142 defines a projection 150 at a front side thereof and a pair of recesses 152 on the lateral sides of the projection 150. The projection 150 extends forward and upward from the front side of the base 142. The arms 220 and 222 of the tiller arm 126 are received in respective ones of the recesses 152 on the respective lateral sides of the projection 150. The arms 220 and 222 of the tiller arm 126 are pivotably connected to the projection 150 via a shaft 174 and a pair of clamping fittings 192, 194 of the tiller hinge mechanism 151. This construction is described in more detail next.

Figure 3:
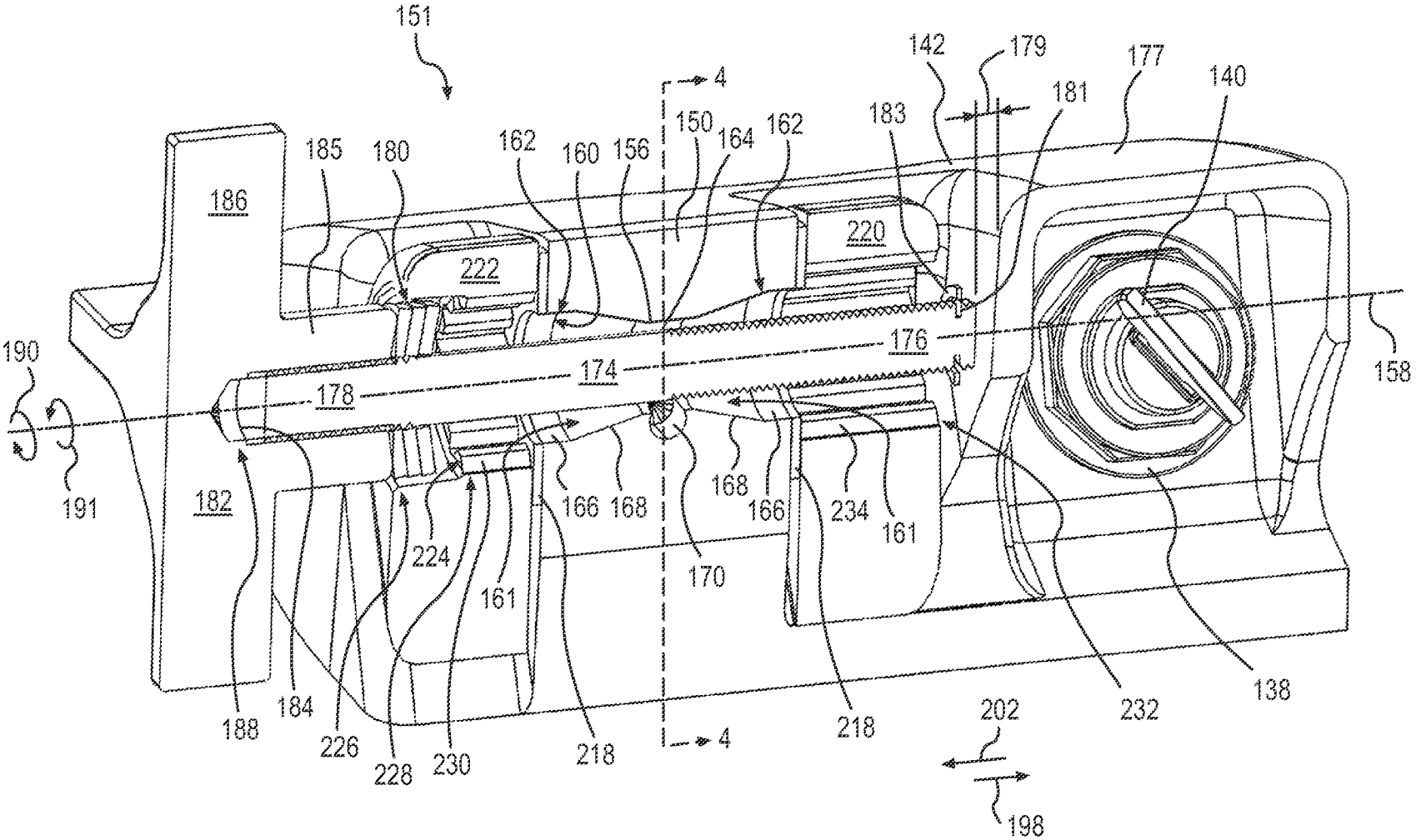
FIG. 3 is a sectional view of a part of the tiller assembly of FIG. 2 with clamping fittings thereof being omitted, taken through section line 3-3 of FIG. 2.
Figure 4:
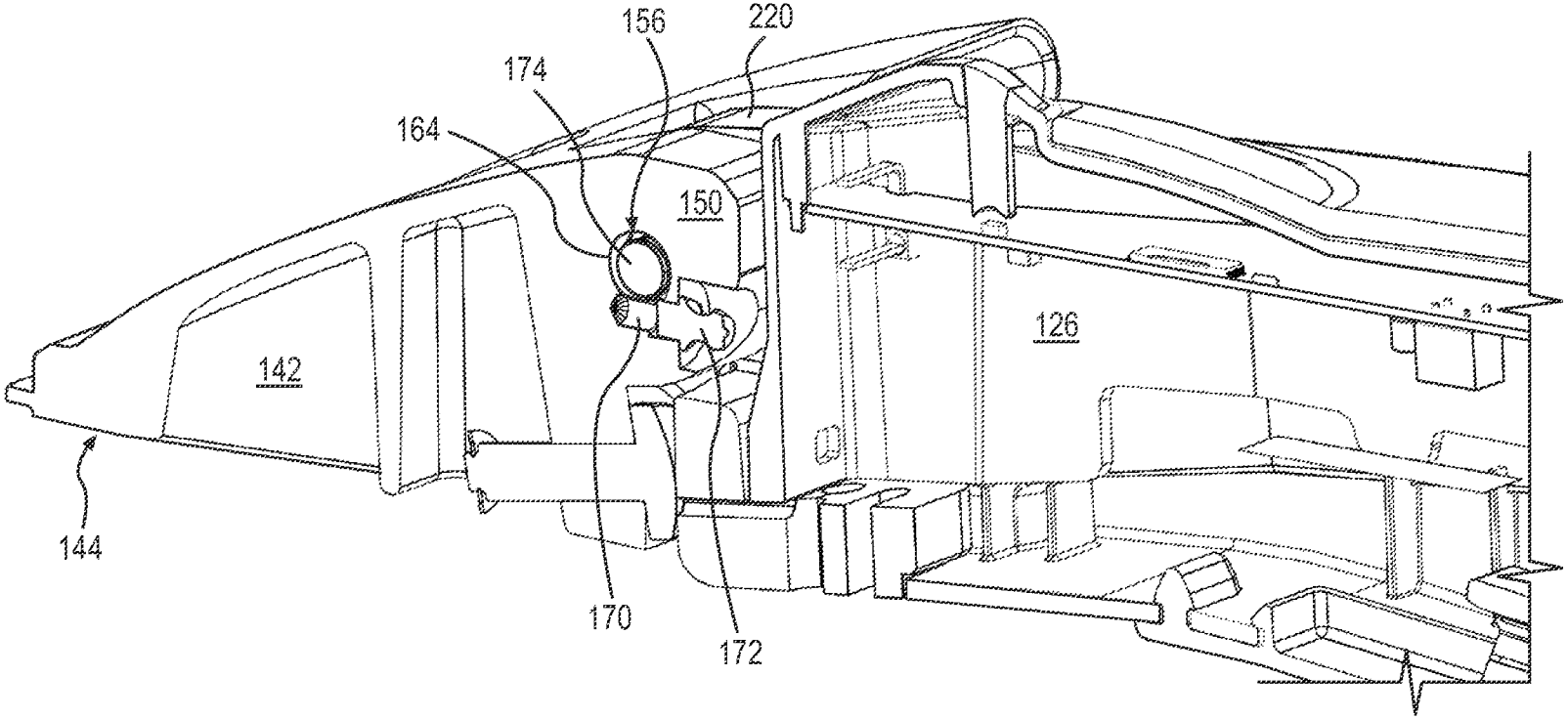
FIG. 4 is a sectional view of a part of the tiller assembly of FIG. 2, taken through section line 4-4 of FIG. 3.
Figure 5:
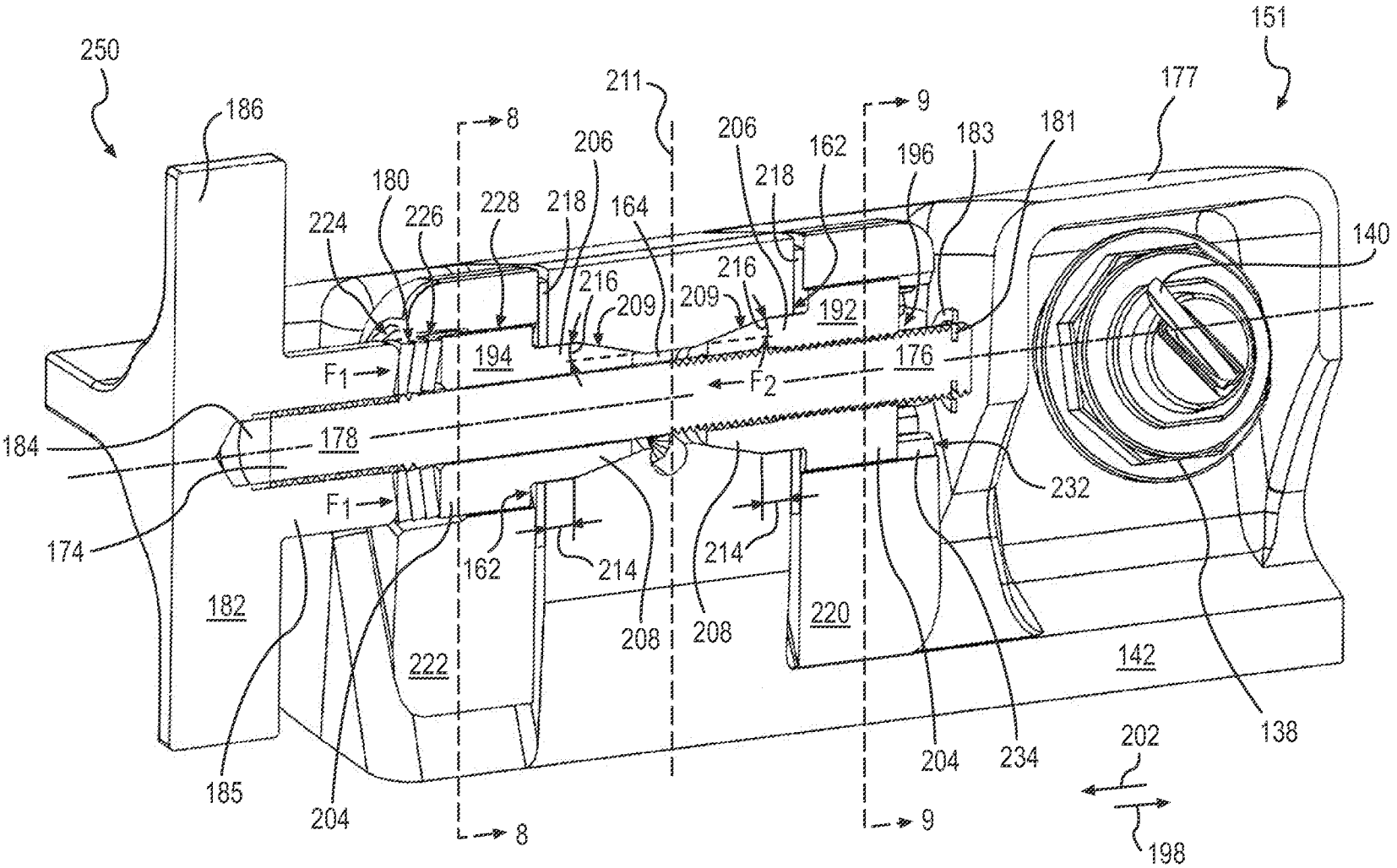
FIG. 5 is the sectional view of the part of the tiller assembly of FIG. 3 with the clamping fittings thereof being shown.

Referring to FIGS. 3 to 5, the base 142 defines a horizontal aperture 156 therein. The horizontal aperture 156 extends laterally through the projection 150 and receives the shaft 174 and parts of the clamping fittings 192, 194 therein to define the axis of rotation 158 of the tiller arm 126. This way, the base 142 defines the axis of rotation 158 of the tiller arm 126. More particularly, the horizontal aperture 156 forms an inner surface 160 of the base 142. The inner surface 160 defines two recesses 162 and a space 164 between the recesses 162. The recesses 162 receive therein respective ones of the clamping fittings 192, 194 of the tiller hinge mechanism 151.

To this end, each of the recesses 162 includes a cylindrical outer portion 166 at an outer lateral end thereof, and a female frusto-conical portion 168. The female frusto-conical portions 168 of the recesses 162 are positioned on opposed lateral sides of the projection 150 of the base 142. The female frusto-conical portions 168 extend from the respective cylindrical outer portions 166 into the projection 150 toward the space 164. The female frusto-conical portions 168 define smooth female tapered surfaces 161 of the base 142. The female frusto-conical portions 168, and the female tapered surfaces 161, taper/narrow toward the space 164. The cylindrical outer portions 166, the female frusto-conical portions 168 and the space 164 are all coaxial with the axis of rotation 158. The shaft 174 and the clamping fittings 192, 194 are also coaxial with the axis of rotation 158.

Now referring in particular to FIG. 4, the base 142 also defines a lubricant channel 170 in the projection 150. The lubricant channel 170 extends from a front end of the projection 150 to the space 164. The lubricant channel 170 at its front end terminates at a nipple 172. The lubricant channel 170 fluidly connects the nipple 172 to the space 164 between the frusto-conical portions 168. A grease-gun (not shown), or other lubricating instrument, can be connected to the nipple 172 for injecting a lubricant, such as a grease, into the space 164. The lubricant lubricates the tiller hinge mechanism 151. It is contemplated that this lubrication system could be omitted or that a different lubrication system could be used.

As shown in FIG. 3, the shaft 174 has a threaded left end 176 and a threaded right end 178. In the present embodiment, the left end 176 defines a circumferentially extending slot 181 in an outer peripheral surface thereof. The slot 181 receives a fastener 183, more precisely a circlip 183 (also known as a c-clip or snap ring), therein. It is contemplated that the slot 181 and the circlip 183 could be omitted. The shaft is made of stainless steel, but other materials are contemplated. The left end 176 of the shaft 174 is positioned on a right side of a projection 177 of the base 142 which covers the key switch 138. The left end 176 of the shaft 174 is spaced from the right side of the projection 177 of the base 142 by a space 179. The space 179 allows the shaft 174 to move, by rotation about the axis of rotation 158, laterally leftward 198 from the position shown in FIG. 3. It is contemplated that the projection 177 could be omitted.

Referring to FIGS. 3 and 5, further in the present embodiment, the three resilient spring washers 180 are received over the right end 178 of the shaft 174. Each of the resilient spring washers 180 defines an axial aperture therein which is slightly larger than the diameter of the shaft 174. The shaft 174 is rotatable relative to the resilient spring washers 180. It is contemplated that a different number of spring washers 180 could be used and that they could be stacked in series, in parallel or some combination thereof. The spring washers 180 are made of stainless steel, but other materials are contemplated. The resilient spring washers 180 are an example of resilient members. It is contemplated that one or more different resilient members could be used instead of, in combination with, or in addition to the resilient spring washers 180.

Still referring to FIGS. 3 and 5, the handle 182 of the tiller hinge mechanism 151 defines a threaded aperture 184 in a leftward-extending projection 185 thereof. The right end 178 of the shaft 174 is threaded into the threaded aperture 184 in the leftward-extending projection 185 of the handle 182 and is locked therein with a set screw. The handle 182 is thereby rotationally fixed relative to the shaft 174. It is contemplated that the handle 182 could be rotationally fixed relative to the shaft 174 via any other suitable means. For example, in some embodiments, the handle 182 could be integral with the shaft 174. The handle 182 has four projections 186 that are disposed radially about the threaded aperture 184 coaxially with the axis of rotation 158. The projections 186 extend radially outward from the leftward-extending projection 185. It is contemplated that other configurations of the handle 182 could be used.

Figure 6:
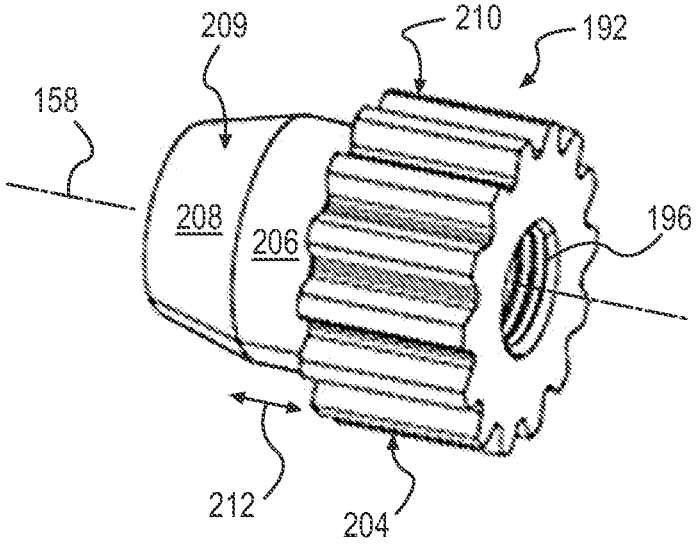
FIG. 6 is a perspective view of a left clamping fitting of FIG. 5, taken from a front, left, top side thereof.
Figure 7:
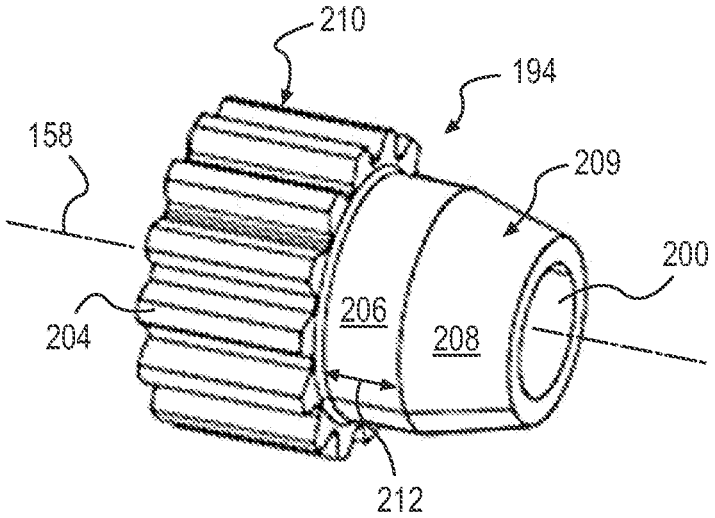
FIG. 7 is a perspective view of a right clamping fitting of FIG. 5, taken from a front, left, top side thereof.

Referring to FIGS. 5 to 7, the clamping fittings 192 and 194 of the tiller hinge mechanism 151 are received over the shaft 174. The clamping fittings 192 and 194 are made of stainless steel, but other materials are contemplated. Referring to FIGS. 5 and 6, the left clamping fitting 192 defines a threaded axial aperture 196 that extends laterally therethrough. The left end 176 of the shaft 174 is threaded into the threaded axial aperture 196. The thread in the threaded axial aperture 196 engages the thread on the left end 176 of the shaft 174. Referring to FIGS. 5 and 7, the right clamping fitting 194 defines an axial aperture 200 that extends laterally therethrough. The diameter of the axial aperture 200 is slightly larger than the diameter of the shaft 174. The axial aperture 200 is smooth inside, and does not have a thread therein. The axial aperture 200 slidably receives the shaft 174 therein. Thus, the shaft 174 is slidable relative to the right clamping fitting 194 along the axis of rotation 158.

The left clamping fitting 192 is received in the recess 162 defined in the lateral left side of the projection 150. The right clamping fitting 194 is received in the recess 162 defined in the lateral right side of the projection 150. As best seen in FIGS. 6 and 7, the clamping fittings 192, 194 both have an outer splined cylindrical portion 204, a smooth cylindrical mid-portion 206, and a smooth male frusto-conical portion 208. The male frusto-conical portions 208 are received in respective ones of the female frusto-conical portions 168 of the recesses 162. In the present embodiment, the female frusto-conical portions 168 of the recesses 162 and the male frusto-conical portions 208 of the clamping fittings 192, 194 are disposed symmetrically about a vertical plane 211 passing through the longitudinal axis 127 of the tiller arm 126.

Still referring to FIGS. 5 to 7, the male frusto-conical portion 208 of the left clamping fitting 192 extends from the cylindrical mid-portion 206 of the left clamping fitting 192 toward the handle 182 (i.e. toward the right). The male frusto-conical portion 208 of the left clamping fitting 192 narrows from the cylindrical mid-portion 206 of the left clamping fitting 192 toward the handle 182. The male frusto-conical portion 208 of the right clamping fitting 194 extends from the cylindrical mid-portion 206 of the right clamping fitting 194 toward the left clamping fitting 192 (i.e. toward the left). The male frusto-conical portion 208 of the right clamping fitting 194 narrows from the cylindrical mid-portion 206 of the right clamping fitting 194 toward the left clamping fitting 192.

Both of the male frusto-conical portions 208 define smooth male tapered surfaces 209. The male tapered surfaces 209 contact and mate with the respective ones of the frusto-conical portions 168 of the recesses 162. The male tapered surface 209 of the left clamping fitting 192 faces toward the handle 182. The male tapered surface 209 of the right clamping fitting 194 faces away from the handle 182. Referring to FIG. 5, the female tapered surfaces 161 of the recesses 162 and the male tapered surfaces 209 of the clamping fittings 192, 194 define respective angles 216 relative to the axis of rotation 158. In the present embodiment, the angles 216 are all equal to 15 degrees from the axis 158. In some embodiments, the angles 216 are different, depending on the particular materials, surface finishes, and construction of the tiller assembly 124 for example.

The choice of taper angle 216 will have an effect on the application and adjustment of the friction between respective female and male tapered surfaces 161 and 209 when the handle 186 is turned clockwise 190 or countered-clockwise 191, a process that will be described in further detail below. As will be appreciated by one skilled in the art, too low an angle 216 may create a locking taper, also known as a self-holding machine taper, that could make loosening the tiller hinge mechanism 151 difficult. In contrast, and as will also be appreciated by one skilled in the art, the greater the angle 216 the less mechanical advantage when adjusting the pivoting resistance of the tiller hinge mechanism 151. It is contemplated that, in some embodiments, the angles 216 could be in a range of at least 7 degrees and up to 45 degrees, or could be in a range of 10 degrees to 20 degrees and in some cases in a range of 14 to 16 degrees.

In the present embodiment, the outer splined cylindrical portion 204 of the left clamping fitting 192 is larger in diameter than the cylindrical mid-portion 206 of the left clamping fitting 192. The splines 210 of the outer splined cylindrical portion 204 of the left clamping fitting 192 are disposed circumferentially about the threaded axial aperture 196 parallel to a central axis of the threaded axial aperture 196. The splines 210 of the outer splined cylindrical portion 204 of the left clamping fitting 192 are parallel to the axis of rotation 158 and are disposed circumferentially about the axis of rotation 158.

Still referring to FIGS. 5 and 7, the outer splined cylindrical portion 204 of the right clamping fitting 194 is slightly larger in diameter than the cylindrical mid-portion 206 of the right clamping fitting 194. The splines 210 of the outer splined cylindrical portion 204 of the right clamping fitting 194 are disposed circumferentially about the axial aperture 200 in parallel to a central axis of the axial aperture 200. The splines 210 of the outer splined cylindrical portion 204 of the right clamping fitting 194 are parallel to the axis of rotation 158. The outer splined cylindrical portions 204 of the left and right clamping fittings 192, 194 are slidably received in corresponding splined apertures 232, 224 defined in the arms 220, 220 of the tiller arm 126.

The aperture 224 in the right arm 222 has a cylindrical portion 226, which at least partly receives the spring washers 180, and a splined cylindrical portion 228, which slidably receives therein the outer splined cylindrical portion 204 of the right clamping fitting 194. To this end, the splined cylindrical portion 228 defines a plurality of internal splines 230 therein as its name suggests.

Figure 8:
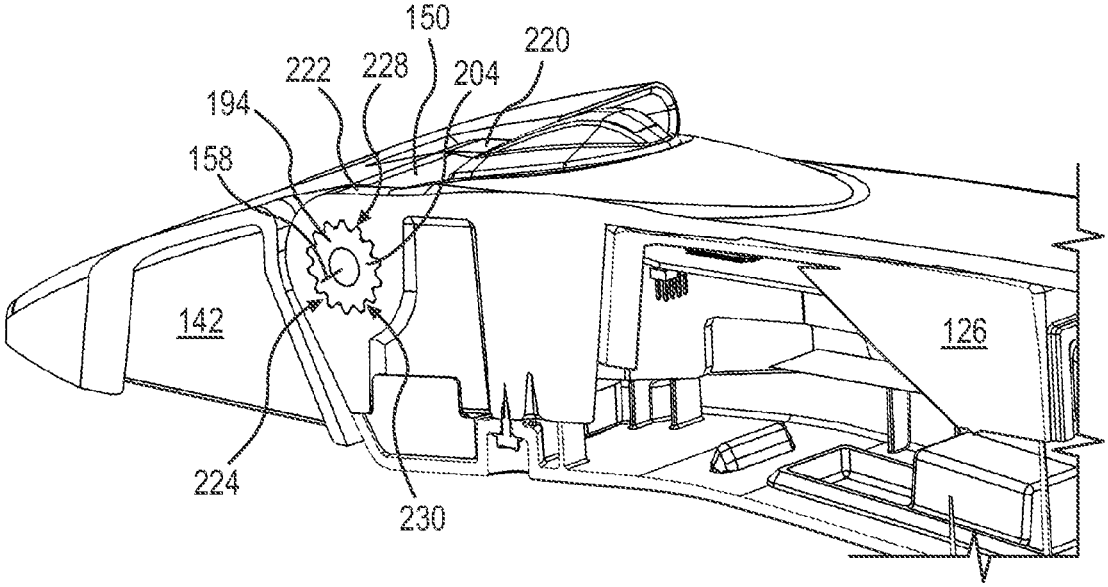
FIG. 8 is a sectional view of a part of the tiller assembly of FIG. 2, taken through section line 8-8 of FIG. 5.

The splines 230 are parallel to the axis of rotation 158 and are disposed circumferentially around the axis of rotation 158. As best shown in FIG. 8, the splines 230 slidably engage the splines of the outer splined cylindrical portion 204 of the right clamping fitting 194. Accordingly, the outer splined cylindrical portion 204 of the right clamping fitting 194 is slidable laterally relative to the right arm 222 of the tiller arm 126, along the axis of rotation 158. Due to the splined connection, the outer splined cylindrical portion 204 of the right clamping fitting 194, and therefore the right clamping fitting 194, is rotationally fixed relative to the tiller arm 126.

Referring back to FIG. 5, the cylindrical portion 226 of the aperture 224 partly receives the three spring washers 180 therein. The diameter of the cylindrical portion 226 is slightly larger than the diameter of the resilient spring washers 180 such that the circumference of the resilient spring washers 180 do not contact the tiller arm 126. It is contemplated that in some embodiments, the resilient spring washers 180 could contact the tiller arm 126. In the present embodiment, the diameter of the cylindrical portion 226 is slightly larger than the diameter of the splined cylindrical portion 228. However, it is contemplated that this need not be the case.

Figure 9:
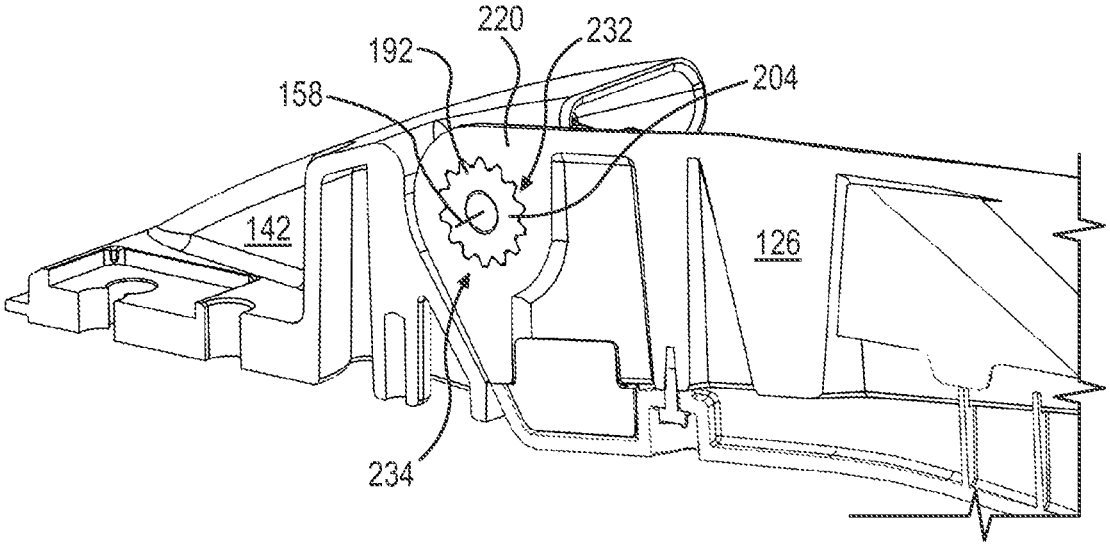
FIG. 9 is a sectional view of a part of the tiller assembly of FIG. 2, taken through section line 9-9 of FIG. 5.

Still referring to FIG. 5, the aperture 232 in the left arm 220 slidably receives therein the outer splined cylindrical portion 204 of the left clamping fitting 192. To this end, similar to the aperture 224, the aperture 232 defines a plurality of splines 234 therein. The splines 234 are parallel to the axis of rotation 158 and are disposed circumferentially around the axis of rotation 158. As best shown in FIG. 9, the splines 234 slidably engage the splines of the outer splined cylindrical portion 204 of the left clamping fitting 192. Accordingly, the outer splined cylindrical portion 204 of the left clamping fitting 192 is slidable laterally relative to the left arm 220 of the tiller arm 126, along the axis of rotation 158. Due to the splined connection, the outer splined cylindrical portion 204 of the left clamping fitting 192, and therefore the left clamping fitting 192, is rotationally fixed relative to the tiller arm 126.

It is contemplated that the splines 210, 230, 234 need not be equidistant from the axis of rotation 158. It is also contemplated that the outer splined cylindrical portions 204 of the clamping fittings 192, 194, and therefore the clamping fittings 192, 194, could be both slidable along the axis of rotation 158 and be rotationally fixed relative to the tiller arm 126 using a different structure, such as a keyed joint or matching non-circular cross-sectional shapes.

The cylindrical mid-portions 206 of the clamping fittings 192, 194 closely match the diameter of the respective ones of the cylindrical outer portions 166 of the recesses 162, while remaining slightly smaller. This close fit between the cylindrical mid-portions 206 and the cylindrical outer portions 166 allows the clamping fittings 192, 194 to slide laterally relative to the recesses 162 and act as bearing surfaces for smooth rotation of the clamping fittings 192, 194, and hence the tiller arm 126 about the base 142. The cylindrical mid-portions 206 of the clamping fittings 192, 194 have axial widths 212 that are slightly larger than the respective widths 214 (FIG. 5) of the cylindrical outer portions 166 of the recesses 162. The outer splined cylindrical portions 204 of the clamping fittings 192, 194 therefore do not contact the flat metal washers 218 that are received between the arms 220, 222 of the tiller arm 126 and the base 142.

The flat metal washers 218 are received over the cylindrical mid-portions 206 of the clamping fittings 192, 194 between the corresponding arms 220, 222 of the tiller arm 126 and the lateral sides of the projection 150 of the base 142 and are provided to aid rotation therebetween. The left side washer 218 is disposed between and contacts the left arm 220 of the tiller arm 126 and the portion of the base 142 that defines the left side recess 162. The right side washer 218 is disposed between and contacts the right arm 222 of the tiller arm 126 and the portion of the base 142 that defines the right side recess 162. As noted above, the outer splined cylindrical portions 204 of the clamping fittings 192, 194 are spaced from the respective ones of the flat metal washers 218.

As shown in FIG. 5, the handle 182 is in contact with the right side of the spring washers 180, the left side of the spring washers 180 is in contact with the right side of the right clamping fitting 194, the male tapered surfaces 209 of the left and right clamping fittings 194 and 192 are in contact with the female tapered surfaces 161 of the left and right recess 162, respectively, and the left clamping fitting 192 is threaded onto the left end 176 of the shaft 174, which is fixed to the handle 182. When the resilient spring washers 180 are compressed between the handle 182 and the right clamping fitting 194 by a leftward 198 axial force, F1, the resilient spring washers 180 in turn press the right clamping fitting 194, and the male tapered surface 209 thereof, against the female tapered surface 161 of the right side recess 162. The axial force F1 thereby creates friction between the male tapered surface 209 of the right clamping fitting 194 and the female tapered surface 161 of the right side recess 162. Since the outer splined cylindrical portion 204 of the right clamping fitting 194 does not contact the right side washer 218, the right clamping fitting 194 does not press on the right side washer 218.

Still referring to FIG. 5, the compression of the resilient spring washers 180 results in the shaft 174 applying an axial force F2 to the left clamping fitting 192. The axial force F2 is directed rightward 202. The left clamping fitting 192, and the male tapered surface 209 thereof, is therefore pressed against the female tapered surface 161 of the left side recess 162. More particularly, the tapered surface 209 of the left clamping fitting 192 is pulled by the axial force F2 against the female tapered surface 161 of the left side recess 162 as the compressed resilient spring washers 180 push rightward against the handle 182. The axial force F2 thereby creates friction between the male tapered surface 209 of the left clamping fitting 192 and the female tapered surface 161 of the left side recess 162. Since the outer splined cylindrical portion 204 of the left clamping fitting 192 does not contact the left side washer 218, the left clamping fitting 192 does not press on the left side washer 218.

The friction between the female tapered surfaces 161 of the base 142 and the male tapered surfaces 209 of the clamping fittings 192, 194 determines the resistance to manually pivoting the tiller arm 126 about the axis of rotation 158 relative to the base 142. This possible pivoting motion is shown with a double-ended arrow 236 in FIG. 1. The resistance of the tiller arm 126 to pivoting about the axis of rotation 158 relative to the base 142 may be referred to as a pivoting resistance. In turn, since the friction between the male and female tapered surfaces 161 and 209 provides the pivoting resistance of the tiller arm 126, the friction may be referred to as a pivoting friction. In the present embodiment, due to the symmetry of the pivot connection between the base 142 and the tiller arm 126, described above, the pivoting friction is at least approximately symmetrically distributed between the projection 150 and the arms 220, 222. More particularly, the pivoting friction is at least approximately symmetrically distributed along the female tapered surfaces 161 and the male tapered surfaces 209.

The construction of the tiller hinge mechanism 151 described herein above allows the pivoting friction, and therefore the pivoting resistance, to be adjusted. To this end, the handle 182 may be manually rotated clockwise 190 to increase the friction, and the pivoting resistance, and counter-clockwise 191 to decrease the friction, and the pivoting resistance. In the present embodiment, turning the handle 182 clockwise 190 rotates the shaft 174 clockwise 190 about the axis of rotation 158 relative to tiller arm 126 and the left clamping fitting 192. This relative rotation of the thread of the left end 176 of the shaft 174 and the thread in the axial aperture 196 of the left clamping fitting 192 draws the left clamping fitting 174 and the handle 182 toward each other. Since the left clamping fitting 174 is pressed up against the left female tapered surface 161, the clockwise rotation 190 of the handle 182 results in the shaft 174 and handle 182 moving leftward 198 relative to both the left clamping fitting 192 and the base 142, as well as the right clamping fitting 194, which is pressed up against the right female tapered surface 161. This further compresses the resilient spring washers 180.

The more the handle 182 is rotated clockwise 190, the harder it pushes 198 against the resilient spring washers 180. The more the resilient spring washers 180 are compressed between the handle 182 and the right clamping fitting 194 the more the male tapered surfaces 209 the clamping fittings 192, 194 press against the female tapered surfaces 161 of the side recesses 162. This increases the pivoting friction between the clamping fittings 192, 194 and the base 142.

In the present embodiment, the handle 182 may be manually rotated counter-clockwise 191 to decrease the pivoting friction, and the pivoting resistance. Doing so moves the shaft 174 rightward 202 relative to both the left clamping fitting 192 and the right clamping fitting 194. This reduces the compression of the resilient spring washers 180 and hence the pivoting friction described above, between the male tapered surfaces 209 of the clamping fittings 192, 194 and the corresponding female tapered surfaces 161 of the recesses 162. It is possible to rotate the handle 182 counter-clockwise 191 to a point where the resilient spring washers 180 are no longer compressed. If counter-clockwise rotation of the handle 182 is continued beyond that point, then a gap will form between at least one of the following pairs: the handle 182 and the springs washers 180, the spring washers 180 and the right clamping fitting 194, the right clamping fitting 194 and the right recess 162, and the left recess 162 and the left clamping fitting 192. It is contemplated that the threaded connections between the left clamping fitting 192 and the shaft 174 could be reversed such that counter-clockwise 191 rotation of the handle 182 would increase the pivoting friction and clockwise 190 rotation of the handle 182 would decrease the pivoting friction. When the handle 182 is manually rotated to a given position, the handle 182 stays in the given position at least for some time until the handle 182 is again manually rotated to a different position.

In the present embodiment, the handle 182 can be manually rotated to at least one equilibrium position 250 in which the tiller hinge mechanism 151, and more particularly the interaction between the resilient washers 180 and the handle 182 and the clamping fittings 192 and 194, holds the tiller arm 126 in an equilibrium state. In the equilibrium state, the tiller arm 126 can be manually pivoted about the axis of rotation 158 against the pivoting friction provided by the tiller hinge mechanism 151 to any desired position relative to the base 142 and will stay in the selected position. While the handle 182 remains in the at least one equilibrium position 250, the tiller hinge mechanism 151 will keep the tiller arm 126 in the selected position against both gravity and at least some of the shocks that may be experienced by the tiller arm 126 and/or the tiller hinge mechanism 151 during normal operation of a watercraft to which the marine outboard engine 100 may be mounted.

In summary, in the at least one equilibrium position 250 of the handle 182, the tiller arm 126 can be manually pivoted by a user about the axis of rotation 158 to a given angular position relative to the base 142. The tiller arm 126 will stay in the given angular position, while the handle 182 is in the equilibrium position 250, until the user decides to again change the given angular position of the tiller arm 126. At that point, and while keeping the handle 182 in the position 250, the user will be able to manually pivot the tiller arm 126 to a different angular position without having to first rotate the handle 182 away from the equilibrium position 250. The tiller arm 126 will stay in the different angular position until the user decides to again change reposition the tiller arm 126 relative to the base 142 about the axis of rotation 158.

Since the male tapered surfaces 209 of the clamping fittings 192, 194 and the female tapered surfaces 161 of the recesses 162 are smooth, the tiller assembly 124 is not limited to a particular pre-determined number of angular positions to which it can be pivoted relative to the base 142 about the axis of rotation 158. The tiller hinge mechanism 151 therefore may be said to provide an infinite number of angular positions to which the tiller arm 126 may be pivoted relative to the base 142. It is contemplated that in some embodiments, the clamping fittings 192, 194 could have female tapered surfaces and the recesses 162 could have male tapered surfaces receivable in and mateable with the female tapered surfaces of the clamping fittings 192, 194.

Figure 10:
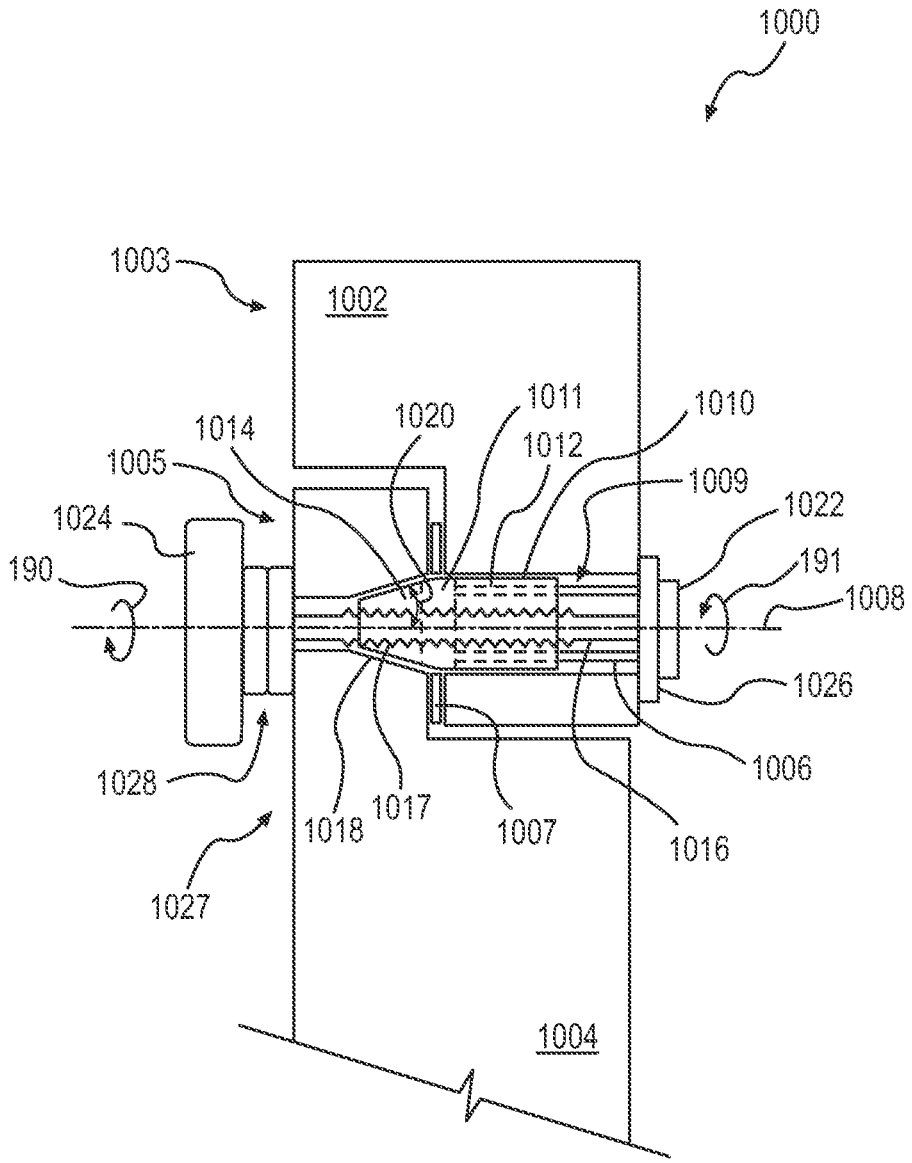
FIG. 10 is a schematic sectional view of an alternative embodiment of the tiller assembly of FIG. 2.

Reference is now made to FIG. 10, which schematically shows a part of a tiller assembly 1000. The tiller assembly 1000 is a different embodiment of the tiller assembly 124. The tiller assembly 1000 includes a base 1002 and a tiller arm 1004. As shown in FIG. 10, the base 1002 and the tiller arm 1004 define complementary L-shapes 1003, 1005, respectively. The tiller arm 1004 is pivotably connected at a rear portion 1027 of the L-shape 1005 to a front portion of the L-shape 1003 of the base 1002 to pivot relative to the base 1002 about an axis of rotation 1008. A flat washer 1007 is received between the rear portion 1027 of the L-shape 1005 of the tiller arm 1004 and the front portion of the L-shape 1003 of the base 1002. Similar to the base 142, the base 1002 can be bolted, or otherwise fixed, to the drive unit 101 of the marine outboard engine 100, to pivot with the drive unit 101 about the steering axis 122 of the marine outboard engine 100.

In this alternative embodiment, instead of the recesses 162 of the base 142, the base 1002 defines a horizontal aperture 1006 therethrough. The horizontal aperture 1006 is similar to the aperture 232 in the tiller arm 126 of the tiller assembly 124. More particularly, the horizontal aperture 1006 is coaxial with, and defines, the axis of rotation 1008 of the tiller arm 1004. The horizontal aperture 1006 defines a plurality of splines therein, which are parallel to and distributed circumferentially about the axis of rotation 1008 of the tiller arm 1004. The splines 1009 of the horizontal aperture 1006 are similar to the splines 234 of the aperture 232 of the tiller assembly 124 and are therefore not described in detail herein.

The horizontal aperture 1006 slidably receives therein an outer splined cylindrical portion 1010 of a single clamping fitting 1012 of the tiller assembly 1000. The splines of the outer splined cylindrical portion 1010 of the single clamping fitting 1012 engage the splines in the horizontal aperture 1006. Accordingly, the single clamping fitting 1012 is slidable relative to the base 1002 along the axis of rotation 1008 and is rotationally fixed relative to the base 1002.

As shown, in the present embodiment, similar to the clamping fittings 192, 194, the single clamping fitting 1012 has an outer splined cylindrical portion 1010, a smooth mid-portion 1011, and a male frusto-conical portion 1014. The male frusto-conical portion 1014 extends from the right end of the smooth mid-portion 1011 toward the handle 1024. Similar to the left clamping fitting 192, the clamping fitting 1012 defines an axial threaded aperture (not separately labeled) therethrough. A shaft 1016 having a threaded mid-portion 1017 is threaded into the axial aperture of the single clamping fitting 1012.

The male frusto-conical portion 1014 is matingly received in a matching female frusto-conical recess 1018 defined through the rear end 1027 of the tiller arm 1004. Both the male frusto-conical portion 1014 of the clamping fitting 1012 and the female frusto-conical recess 1018 are coaxial with the axis of rotation 1008. The smooth surface of the clamping fitting 1012 that defines its male frusto-conical portion 1014 and the smooth surface of the tiller arm 1004 that defines the female frusto-conical recess 1018 together define a 12 degree angle 1020 relative to the axis of rotation 1008.

In this embodiment, the shaft 1016 at one end thereof terminates at a head 1022 and at the other end thereof terminates at the handle 1024. Both the head 1022 and the handle 1024 are rotationally and longitudinally fixed relative to the shaft 1016. A flat washer 1026 is received over the one end of the shaft 1016 between the head 1022 of the shaft 1016 and a left side surface of the base 1002. Two resilient washers 1028 are received over the other end of the shaft 1016 and are compressed between the handle 1024 and a right side surface of the tiller arm 1004. It is contemplated that the resilient washers 1028 could be received in a recess in the right side surface of the tiller arm 1004, i.e. a counterbore. The shaft 1016 together with the clamping fitting 1012 and the base 1002 define the axis of rotation 1008 of the tiller arm 1004.

Rotation of the handle 1024 about the axis of rotation 1008 causes the shaft 1016 to rotate about the axis of rotation 1008 relative to the clamping fitting 1012. In this embodiment, when the handle 1024 is rotated clockwise 190 about the axis of rotation 1008 toward a given position, the thread of the shaft 1016 engages and rotates relative to the thread in the axial aperture of the clamping fitting 1012, which draws the handle 1024 towards the tiller arm 1004 and further compresses the resilient washers 1028. As this happens, the shaft 1016 pushes the male tapered surface of the frusto-conical portion 1014 of the clamping fitting 1012 against the female tapered surface of the female frusto-conical recess 1018. Since the clamping fitting 1012 is rotationally fixed relative to the base 1002, the increased friction between the clamping fitting 1012 and the tiller arm 1004 increases the pivoting friction between the base 1002 and the tiller arm 1004.

Similar to the tiller assembly 124, the handle 1024 can be rotated about the axis of rotation 1008 to at least one position in which the tiller arm 1004 both: a) resists gravity and normal shocks and remains in a given angular position relative to the base 1002, and b) allows a user of the marine outboard engine 100 to manually change the given angular position of the tiller arm 1004 without having to readjust the position of the handle 1024.

It is contemplated that in some embodiments the threading of the shaft 1006 and the clamping fitting 1012 could be selected such that counter-clockwise 191 rotation of the handle 1024 would increase friction between the clamping fitting 1012 and the tiller arm 1004, and therefore the pivoting friction of the tiller arm 1004 relative to the base 1002. In such embodiments, the pre-determined direction for decreasing friction between the clamping fitting 1012 and the tiller arm 1004, and therefore the pivoting friction of the tiller arm 1004 relative to the base 1002, would be clockwise 190.

Figure 11:
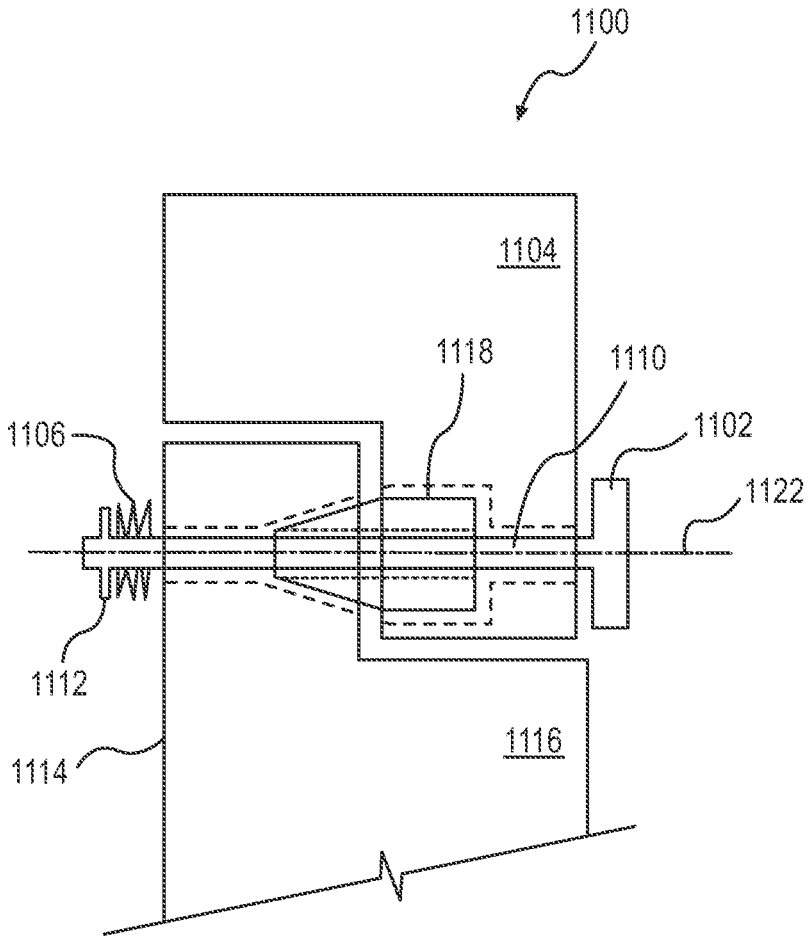
FIG. 11 is a schematic sectional view of another alternative embodiment of the tiller assembly of FIG. 2.

Reference is now made to FIG. 11, which schematically shows a part of a tiller assembly 1100. The tiller assembly 1100 is a different embodiment of the tiller assembly 1000. The tiller assembly 1100 is similar to the tiller assembly 1000 and is therefore not described in detail herein.

One difference between the tiller assembly 1100 and the tiller assembly 1000 is that in the tiller assembly 1100, the handle 1102 is positioned on the opposite lateral side of the base 1104 as the resilient member 1106. Another difference between the tiller assembly 1100 and the tiller assembly 1000 is that the resilient member 1106 is a coil spring 1106. The spring 1106 replaces and is equivalent to the resilient washes. The spring 1106 is compressed by a head 1112 of the shaft 1110 against the lateral right side 1114 of the tiller arm 1116. Similar to the clamping fitting 1012, the clamping fitting 1118 and the base 1104 comprise corresponding splined surfaces such that the clamping fitting 1118 is rotationally fixed with respect to the base 1104, and the clamping fitting 1118 and the tiller arm 1116 comprise a male frusto-conical portion and corresponding female frusto-conical recess, respectively. Also similar to the clamping fitting 1012, the clamping fitting 1118 defines an axial threaded aperture (not separately labeled) therethrough. The thread in the axial threaded aperture of the clamping fitting 1118 engages a correspondingly threaded portion of the shaft 1110. Accordingly, when the coil spring 1106 is compressed, rotation of the handle 1102 will change the friction between the clamping fitting 1118 and the tiller arm 1116.

As in the tiller assembly 1000, the handle 1102 of the tiller assembly 1100 is rotatable about the axis of rotation 1122 to at least one equilibrium position in which the tiller arm 1116 is in an equilibrium state and both: a) remains in a given angular position relative to the base 1104, and b) allows a user of the marine outboard engine 100 to manually change the given angular position of the tiller arm 1116 without having to readjust the position of the handle 1102.

Figure 12:
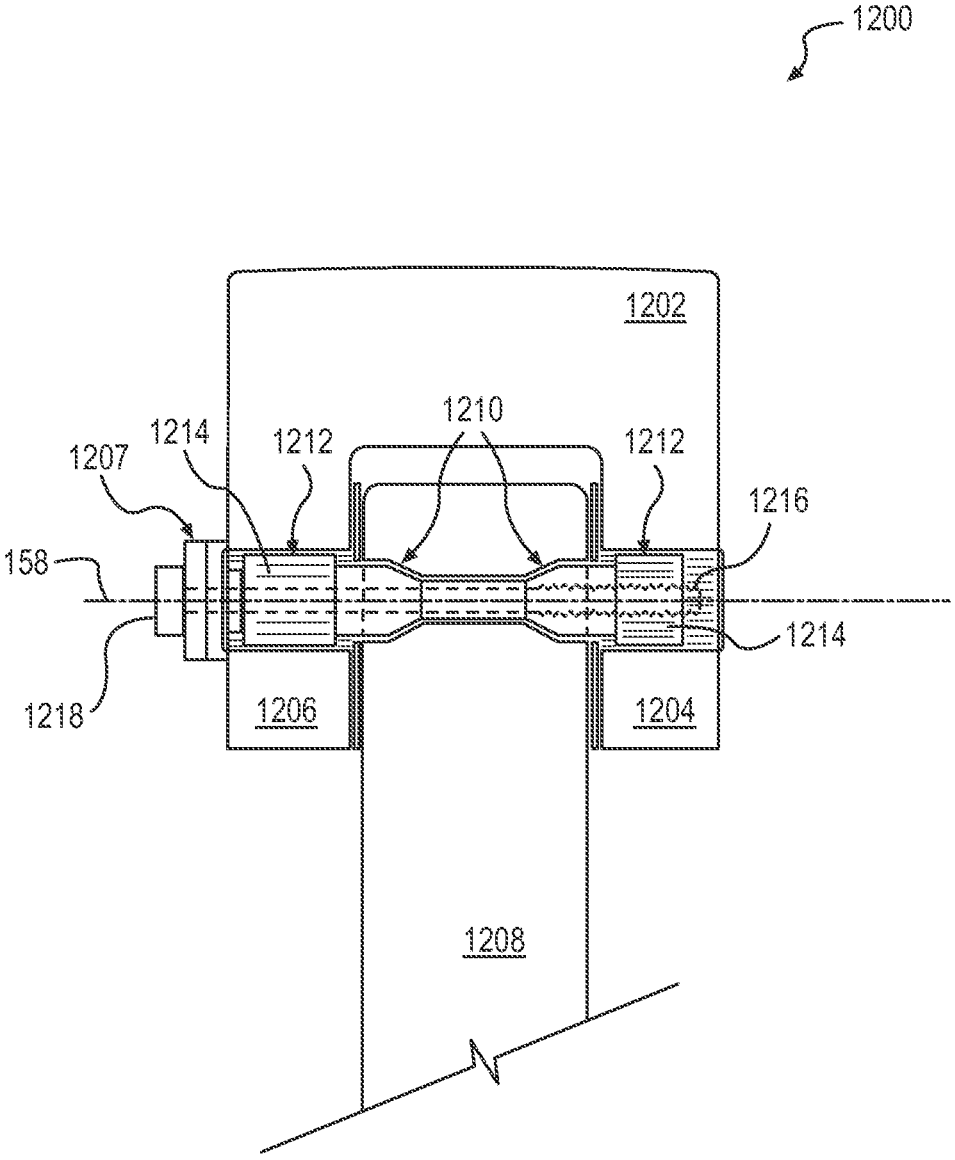
FIG. 12 is a schematic sectional view of another alternative embodiment of the tiller assembly of FIG. 2.

Reference is now made to FIG. 12, which schematically shows a part of a tiller assembly 1200. The tiller assembly 1200 is a yet another different embodiment of the tiller assembly 124. The tiller assembly 1200 is similar to the tiller assembly 124, and therefore the tiller assembly 1200 is not described herein in detail.

One difference between the tiller assembly 1200 and the tiller assembly 124 is that in the tiller assembly 1200, it is the base 1202 and not the tiller arm 1208 that defines a pair of arms 1204, 1206. The pair of arms 1204, 1206 receive therebetween the rear end of the tiller arm 1208. Another difference between the tiller assembly 1200 and the tiller assembly 124 is that in the tiller assembly 1200, the resilient metal washers 1207 are not all of the same size.

Another difference between the tiller assembly 1200 and the tiller assembly 124 is that in the tiller assembly 1200, it is the tiller arm 1208 and not the base 1202 that defines the female frusto-conical recesses 1210 therein. Also, in the tiller assembly 1200, it is the base 1202 that defines the splined apertures 1212 therein, the splined apertures 1212 slidably receiving the splined portions of the respective ones of the clamping fittings 1214 therein. Accordingly, in the tiller assembly 1200, the clamping fittings 1214 are rotationally fixed relative to the base 1202.

Similar to the tiller assembly 124, in the tiller assembly 1200, it is the left clamping fitting 1214 that is threaded onto and operatively engages with the shaft 1216. Operation of the tiller assembly 1200 is similar to the operation described above with respect to the tiller assembly 124, and is therefore not described in more detail herein.

Figure 13:
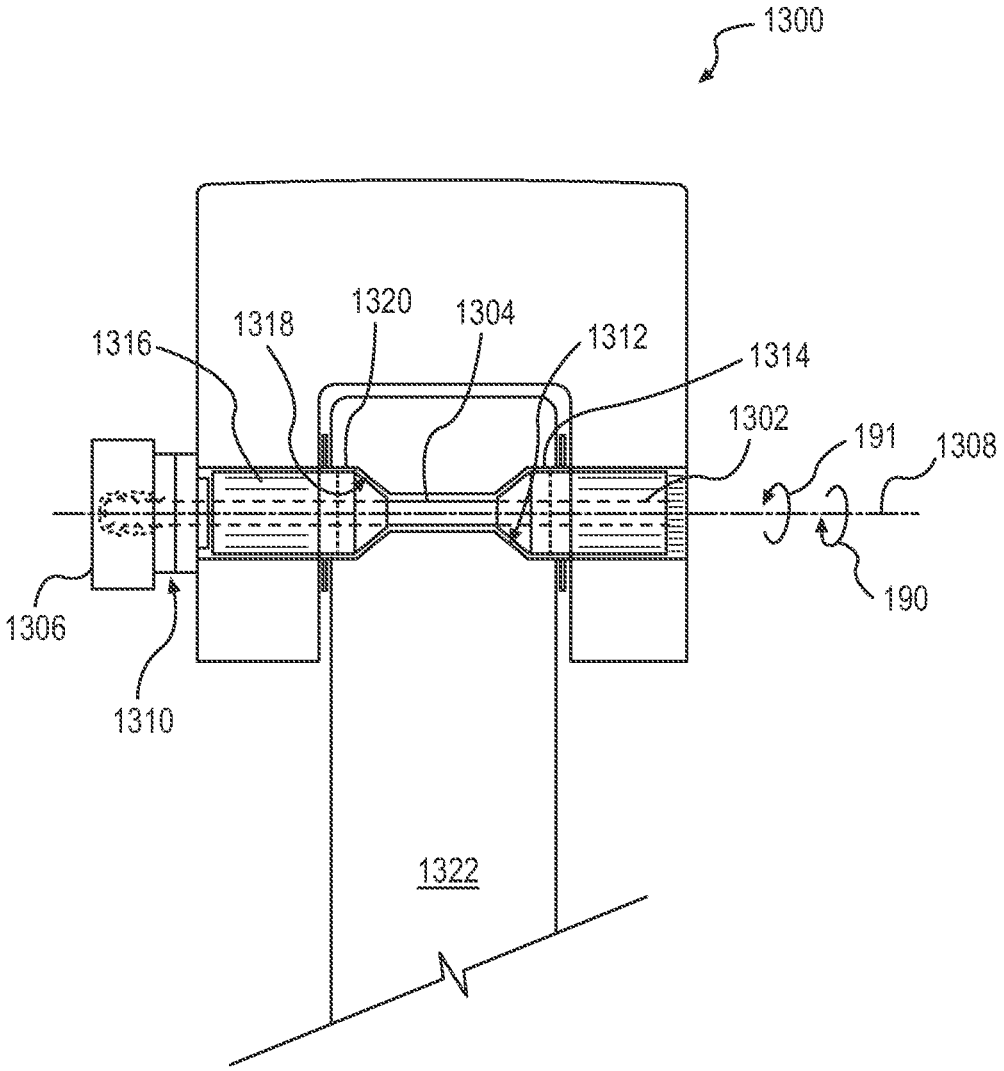
FIG. 13 is a schematic sectional view of another alternative embodiment of the tiller assembly of FIG. 2.

Reference is now made to FIG. 13, which schematically shows a part of a tiller assembly 1300. The tiller assembly 1300 is a different embodiment of the tiller assembly 1200. The tiller assembly 1300 is similar to the tiller assembly 1200, and therefore the tiller assembly 1300 is not described herein in detail.

One difference between the tiller assembly 1300 and the tiller assembly 1200 is that in the tiller assembly 1300, the left clamping fitting 1302 is both laterally and rotationally fixed to the shaft 1304. More particularly, the shaft 1304 is received in a central axial aperture defined in the left clamping fitting 1302 and is fixed laterally and rotationally to the left clamping fitting 1302 with a set screw. It is contemplated that any suitable means for laterally and rotationally fixing the left clamping fitting 1302 to the shaft 1304 could be used instead of or in addition to the set crew. Another difference between the tiller assembly 1300 and the tiller assembly 1200 is that in the tiller assembly 1300, the handle 1306 is threaded onto the right end of the shaft 1304 such that the handle 1306 can be manually rotated by a user of the marine outboard engine 100 about the axis of rotation 1308 relative to the shaft 1304.

Rotating the handle 1306 clockwise 190 relative to the shaft 1304 threads the shaft 1304 further into the handle 1306. This reduces the distance between the handle 1306 and the left clamping fitting 1302 and thereby pushes the handle 1306 harder against the resilient washers 1310 and the left clamping fitting 1302 harder against the female tapered surface 1312 in the left side recess 1314. The right clamping fitting 1316 in turn pushes harder against the female tapered surface 1318 of the right side recess 1320. The pivoting friction thereby increases at least approximately symmetrically on the left and right sides of the tiller arm 1322.

Rotating the handle 1306 counter-clockwise 191 relative to the shaft 1304 unthreads the shaft 1304 out of the handle 1306. This increases the distance between the handle 1306 and both the left clamping fitting 1302 and the right clamping fitting 1316. This reduces the magnitude of the force with which the handle 1306 and the resilient washers 1310 push the right clamping fitting 1316 against the tapered surface 1318 of the right side recess 1320. The increased distance between the handle 1306 and the left clamping fitting 1302 also reduces the force with which the left clamping fitting 1302 pushes against the tapered surface 1312 in the left side recess 1314. The pivoting friction thereby decreases at least approximately symmetrically on the left and right sides of the tiller arm 1322.

Figure 14:
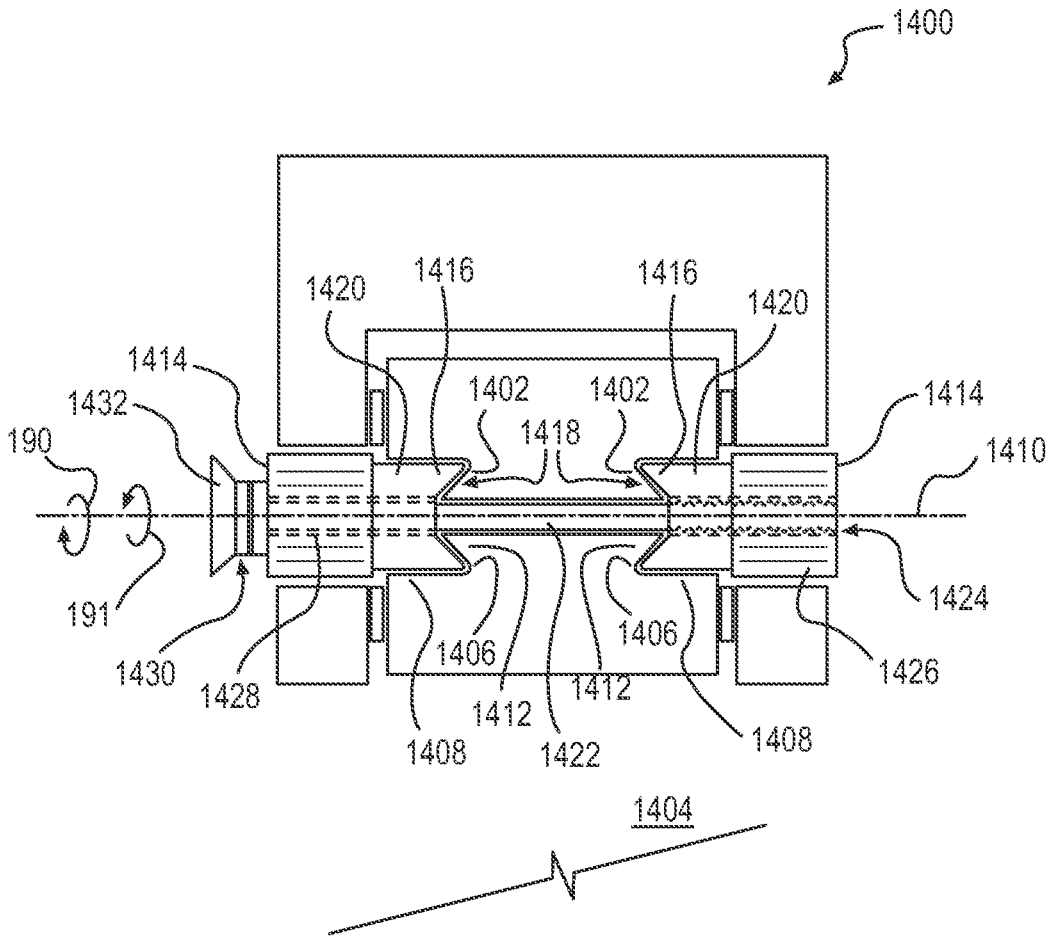
FIG. 14 is a schematic sectional view of another alternative embodiment of the tiller assembly of FIG. 2.

Reference is now made to FIG. 14, which schematically shows a part of a tiller assembly 1400. The tiller assembly 1400 is a another different embodiment of the tiller assembly 1200. The tiller assembly 1400 is similar to the tiller assembly 1200, and therefore the tiller assembly 1400 is not described herein in detail.

One difference between the tiller assembly 1400 and the tiller assembly 1200 is that in the tiller assembly 1400, the recesses 1402 defined in the tiller arm 1404 are defined in part by male tapered surfaces 1406 instead of female tapered surfaces. More particularly, as shown in FIG. 14, each of the recesses 1402 has a smooth outer cylindrical portion 1408 and a smooth male frusto-conical portion 1412. The outer cylindrical portions 1408 and the male frusto-conical portions 1412 are all coaxial with the axis of rotation 1410. The male frusto-conical portions 1412 define the respective ones of the male tapered surfaces 1406.

Another difference between the tiller assembly 1400 and the tiller assembly 1200 is that in the tiller assembly 1400, the clamping fittings 1414 define female frusto-conical portions 1416 instead of male frusto-conical portions. Each of the female frusto-conical portions 1416 defines a female tapered surface 1418 at an inward lateral side thereof and a smooth cylindrical mid-section 1420 that is disposed circumferentially about the female tapered surface 1418. The female frusto-conical portions 1416, the female tapered surfaces 1418, and the smooth cylindrical mid-sections 1420 are all coaxial with the axis of rotation 1410.

The female frusto-conical portions 1416 of the clamping fittings 1414 are received in the respective ones of the recesses 1402 such that the female tapered surfaces 1418 of the clamping fittings 1414 contact and mate with respective ones of the male tapered surfaces 1406 of the tiller arm 1404 in the recesses 1402. The smooth cylindrical mid-sections 1420 of the clamping fittings 1414 are received in part in respective ones of the recesses 1402.

Similar to the tiller assembly 1200, in the tiller assembly 1400, the left clamping fitting 1414 is threaded onto and operatively engages the thread on the left end of the shaft 1422. In the tiller assembly 1400, the threaded axial aperture 1424 of the left clamping fitting 1414 extends the entire width of the left clamping fitting 1414, from the lateral right side of the female frusto-conical portion 1416 to the lateral left side of the splined outer portion 1426.

As in the tiller assembly 1200, the shaft 1422 of the tiller assembly 1400 is received through and slidably engages a smooth inner surface of the non-threaded axial aperture 1428 of the right clamping fitting 1414. However, in the tiller assembly 1400, two resilient washers 1430 are used instead of the three resilient washers 1207 of the tiller assembly 1200. The two resilient washers 1430 are compressed by the handle 1432 against the right clamping fitting 1414. As in the tiller assembly 1200, the handle 1432 is rotationally and laterally fixed to the shaft 1422, and is coaxial therewith.

Operation of the tiller assembly 1400 is similar to the operation described above with respect to the tiller assembly 1200, and is therefore not described in more detail herein.

Figure 15:
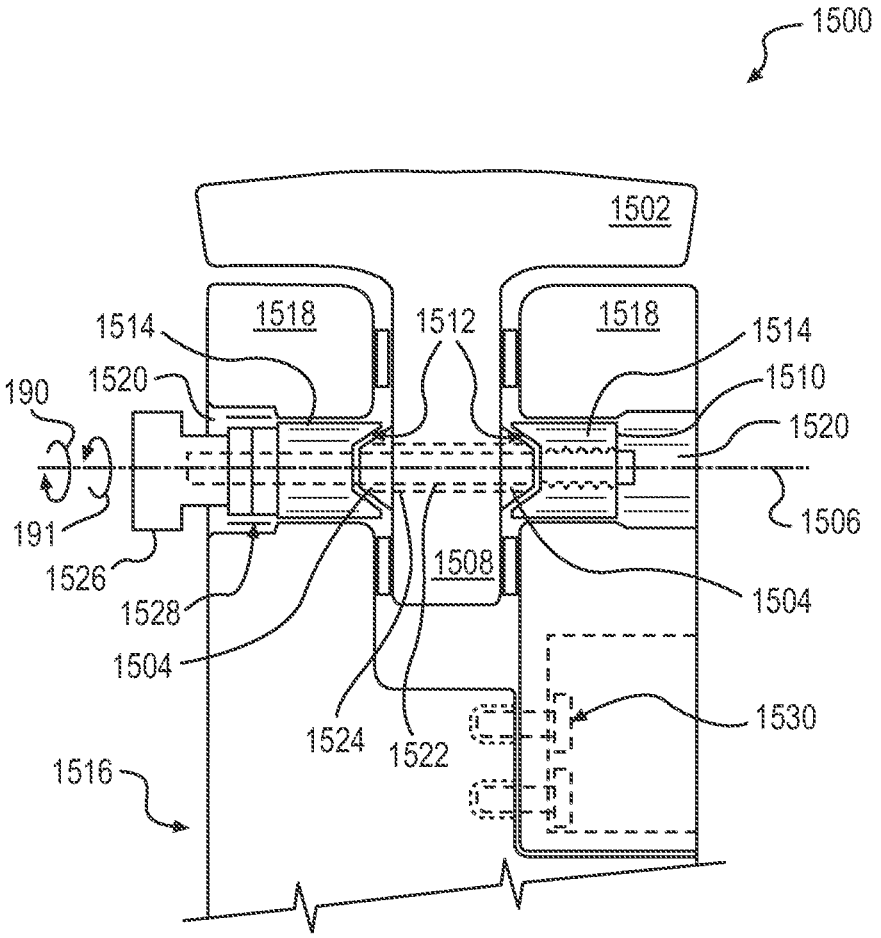
FIG. 15 is a schematic sectional view of another alternative embodiment of the tiller assembly of FIG. 2.

Reference is now made to FIG. 15, which schematically shows a part of a tiller assembly 1500. The tiller assembly 1500 is a another different embodiment of the tiller assembly 1400. The tiller assembly 1500 is similar to the tiller assembly 1400, and therefore the tiller assembly 1500 is not described herein in detail.

One difference between the tiller assembly 1500 and the tiller assembly 1400 is that in the tiller assembly 1500, the base 1502 defines smooth frusto-conical male tapered surfaces 1504 on lateral sides thereof. More particularly, as shown in FIG. 15, each of the frusto-conical male tapered surfaces 1504 is coaxial with the axis of rotation 1506 and extends laterally outward away from respective ones of the lateral sides of a central portion 1508 of the base 1502.

Accordingly, in the tiller assembly 1500, each of the clamping fittings 1510 defines a smooth frusto-conical female tapered surface 1512 on an inward lateral side thereof, and a splined cylindrical outer surfaces 1514 disposed circumferentially about the frusto-conical female tapered surface 1512. The frusto-conical female tapered surfaces 1512 and the splined cylindrical outer surfaces 1514 of the clamping fittings 1510 are all coaxial with the axis of rotation 1506.

Similar to the tiller assembly 124, the tiller arm 1516 of the tiller assembly 1500 has two arms 1518 at a rear end thereof. The arms 1518 are disposed on respective ones of the lateral sides of the central portion 1508 of the base 1502. To help with assembly of the tiller assembly 1500, the left arm 1518 of the tiller arm 1516 is removably attached, via bolts 1530, to the right tiller arm 1518. It is contemplated that the left arm 1518 of the tiller arm 1516 could be removably attached to the right tiller arm 1518 via any other suitable removable attachment means.

It is also contemplated that another part of the tiller assembly 1500 could be made removable to facilitate assembly of the tiller assembly 1500. It is also contemplated that the arm(s) 1518 need not be detachable and instead the base 1502 could define recesses coaxially with the axis of rotation 1506. In such embodiments, the frusto-conical male tapered surfaces 1504 of the base 1502 could be defined inside such recesses. Such recesses could be shaped similar to the recesses 1402 of the tiller assembly 1400, which in that embodiment are defined in the tiller arm 1404 of the tiller assembly 1400.

In the tiller assembly 1500, the arms 1518 of the tiller arm 1516 are pivotably connected to the base 1502 to pivot about the axis of rotation 1506. More particularly, similar to the tiller assembly 124, the splined cylindrical outer surfaces 1514 of the clamping fittings 1510 of the tiller assembly 1500 are splined to corresponding splined apertures 1520 defined in respective ones of the arms 1518. Thus, the clamping fittings 1510 are slidable relative to the tiller arm 1516 along the axis of rotation 1506 and are rotationally fixed relative to the tiller arm 1516 and the axis of rotation 1506. Also similar to the tiller assembly 124, the clamping fittings 1510 are received over a shaft 1522. The shaft 1522 is received through a smooth axial aperture 1524 defined through the base 1502. The axial aperture 1524 in the base 1502 is coaxial with the axis of rotation 1506. Therefore, the shaft 1522 is slidable relative to the base 1502 along the axis of rotation 1506.

Similar to the tiller assembly 124, in the tiller assembly 1500 the left end of the shaft 1522 is threaded into a matching threaded axial aperture (not separately labeled) defined in the left clamping fitting 1510. The right end of the shaft 1522 is received in and fixed to a handle 1526. Also similar to the tiller assembly 124, the shaft 1522 passes through a smooth axial aperture (not separately labeled) defined through the right clamping fitting 1510 and receives thereon a pair of resilient washers 1528. The shaft 1522 is slidable relative to the right clamping fitting 1510.

The pair of resilient washers 1528 is disposed between the handle 1526 and the right clamping fitting 1510, and is compressed by the handle 1526 against the lateral right side of the right clamping fitting 1510. The pair of resilient washers 1528 thereby press the female tapered surface 1512 of the right clamping fitting 1510 against the male tapered surface 1504 of the base 1502.

Operation of the tiller assembly 1500 is similar to the operation described above with respect to the tiller assemblies 124 and 1400 and is therefore not described in more detail herein.

It is contemplated that the tiller assemblies described herein above could be provided as tiller assembly kits. It is contemplated that the tiller assembly kits could be used in the assembly of new marine outboard engines or to replace existing tiller assemblies of at least some existing marine outboard engines. For example, a tiller assembly kit for assembling the tiller assembly 124 described above could contain the base 142, the tiller arm 126, the shaft 174, the washers 180, 218, the handle 182, and the clamping fittings 192, 194. The tiller assembly kit could also contain the circlip 183 for the left end 176 of the shaft 174 and instructions on how to assemble the tiller assembly 124 and mount the tiller assembly to a marine outboard engine. It is also contemplated that the tiller assembly kit for assembling the tiller assembly 124 could include adapter hardware permitting mounting of the tiller assembly 124 onto different models and brands of marine outboard engines.

It is contemplated that any suitable material(s) and manufacturing methods could be used, so long as the functionality described in this document is provided. Modifications and improvements to the above-described embodiments of the present technology may become apparent to those skilled in the art. The foregoing description is intended to be exemplary rather than limiting.

What is claimed is:

1. A tiller assembly for a marine outboard engine, comprising:

a base adapted to pivot relative to a steering axis of the marine outboard engine and defining an axis of rotation that is perpendicular to the steering axis;

a tiller arm pivotably connected to the base to pivot relative to the base about the axis of rotation for adjusting an angular position of the tiller arm relative to the base;

one of the base and the tiller arm defining a recess, the recess being coaxial with the axis of rotation and being at least partially defined by a female tapered surface;

a shaft extending through the base and the tiller arm, the shaft extending through the recess, the shaft defining the axis of rotation, the shaft having a first threaded portion;

a clamping fitting connected to the shaft and received at least in part in the recess, the clamping fitting being rotationally fixed relative to another one of the base and the tiller arm, the clamping fitting having a male tapered surface received at least in part in the recess; and a handle, at least one of the handle and the clamping fitting having a second threaded portion engaged with the first threaded portion, wherein rotation of the first threaded portion relative to the second threaded portion in a pre-determined direction causes the male tapered surface of the clamping fitting to press against the female tapered surface of the recess.

2. The tiller assembly of claim 1, wherein:

the other one of the base and the tiller arm defines a plurality of first splines disposed circumferentially about the axis of rotation; and the clamping fitting has a plurality of second splines engaging the plurality of first splines.

3. The tiller assembly of claim 1, further comprising at least one resilient member arranged in compression so as to press the male tapered surface of the clamping fitting against the female tapered surface of the recess.

4. The tiller assembly of claim 3, wherein the at least one resilient member is arranged in compression between:

one of the handle and the shaft, and one of the base and the tiller arm, so as to push the male tapered surface of the clamping fitting against the female tapered surface of the recess.

5. The tiller assembly of claim 3, wherein the at least one resilient member is disposed between the handle and the clamping fitting.

6. The tiller assembly of claim 1, wherein:

the clamping fitting has the second threaded portion;

the female tapered surface of the recess faces away from the handle; and the rotation of the first threaded portion relative to the second threaded portion in the pre-determined direction causes the shaft to rotate in the pre-determined direction about the axis of rotation and to thereby press the male tapered surface of the clamping fitting toward the handle against the female tapered surface of the recess.

7. The tiller assembly of claim 2, wherein:

the recess has a cylindrical portion and a frusto-conical portion;

the cylindrical portion and the frusto-conical portion are coaxial with the axis of rotation; and the frusto-conical portion extends and narrows from the cylindrical portion toward the handle.

8. The tiller assembly of claim 7, wherein:

the recess is a first recess defined in a portion of the base;

the clamping fitting is a first clamping fitting;

the base defines a second recess in the portion of the base opposite the first recess, the second recess having a cylindrical portion and a female tapered surface that are coaxial with the axis of rotation, the female tapered surface of the second recess extending and narrowing from the cylindrical portion of the second recess toward the first recess;

the tiller arm defines the plurality of first splines and a plurality of third splines disposed circumferentially about the axis of rotation; and the tiller assembly further includes a second clamping fitting, the second clamping fitting slidably engaging the shaft and comprising a male tapered surface and a plurality of fourth splines disposed circumferentially about the axis of rotation, the second clamping fitting being received at least in part in the second recess, the male tapered surface of the second clamping fitting pressing against the female tapered surface of the second recess, the plurality of fourth splines of the second clamping fitting engaging the plurality of third splines of the tiller arm.

9. The tiller assembly of claim 8, wherein:

the tiller arm defines a first arm at a rear end of the tiller arm, the first arm defining a first aperture coaxial with the axis of rotation, the first aperture comprising the plurality of first splines therein;

the tiller arm defines a second arm at the rear end of the tiller arm, the second arm defining a second aperture coaxial with the axis of rotation, the second aperture comprising the plurality of third splines therein;

the first and second clamping fittings are slidable relative to the tiller arm along the axis of rotation and are rotationally fixed relative to the tiller arm; and the portion of the base defining the first and second recesses therein is received between the first arm and the second arm.

10. The tiller assembly of claim 9, wherein:

the second clamping fitting is disposed between the first clamping fitting and the handle;

the tiller assembly further includes at least one resilient member disposed between the handle and the second clamping fitting; and the handle presses the at least one resilient member against the second clamping fitting.

11. The tiller assembly of claim 3, wherein:

the handle has the second threaded portion;

the clamping fitting is rotationally fixed relative to the shaft; and the handle is rotatable relative to the shaft in the pre-determined direction, the handle rotating relative to the shaft in the pre-determined direction causing the first threaded portion to operate against the second threaded portion to thereby press the handle against the at least one resilient member, the at least one resilient member thereby pressing against the clamping fitting.

12. The tiller assembly of claim 1, wherein the male tapered surface of the clamping fitting and the female tapered surface of the recess each have a smooth frusto-conical surface.

13. The tiller assembly of claim 12, wherein the frusto-conical surfaces of the clamping fitting and the recess define an angle with the axis of rotation, the angle being between 7 degrees and 45 degrees.

14. The tiller assembly of claim 13, wherein the angle is between 14 and 16 degrees.

15. A marine outboard engine, comprising:

a stern bracket attachable to a watercraft;

a swivel bracket pivotably connected to the stern bracket to pivot relative to the stern bracket about a tilt/trim axis;

a drive unit pivotably connected to the swivel bracket for pivoting with the swivel bracket about the tilt/trim axis and for pivoting relative to the swivel bracket about the steering axis; and the tiller assembly of claim 1, the base of the tiller assembly being attached to the drive unit for pivoting the drive unit about the steering axis.

16. A tiller assembly kit for a marine outboard engine, comprising:

a base for being connected to the marine outboard engine to pivot relative to a steering axis of the marine outboard engine, the base defining an axis of rotation that is perpendicular to the steering axis when the base is connected to the marine outboard engine;

a tiller arm for being pivotably connected to the base to pivot relative to the base about the axis of rotation for adjusting an angular position of the tiller arm relative to the base, the axis of rotation being perpendicular to the steering axis when the tiller assembly kit is assembled and attached to the marine outboard engine;

one of the base and the tiller arm defining a recess, the recess being coaxial with the axis of rotation when the tiller assembly kit is assembled and being at least partially defined by a female tapered surface;

a shaft for being received through the base and the tiller arm and for extending through the recess, the shaft having a first threaded portion;

a clamping fitting for being connected to the shaft and for being received at least in part in the recess, the clamping fitting being adapted to be rotationally fixed relative to another one of the base and the tiller arm when the tiller assembly kit is assembled, the clamping fitting having a male tapered surface shaped to be received at least in part in the recess when the tiller assembly kit is assembled; and a handle adapted to be connected to the shaft, at least one of the handle and the clamping fitting having a second threaded portion, wherein when the tiller assembly kit is assembled, rotation of the first threaded portion relative to the second threaded portion in a pre-determined direction causes the male tapered surface of the clamping fitting to press against the female tapered surface of the recess.

17. The tiller assembly kit of claim 16, wherein the handle, the female tapered surface, and the male tapered surface are adapted to be coaxial with the axis of rotation of the tiller arm when the tiller assembly kit is assembled.

18. The tiller assembly kit of claim 16, wherein:

the other one of the base and the tiller arm defines a plurality of first splines disposed circumferentially about the axis of rotation;

the clamping fitting has the second threaded portion and a plurality of second splines engaging the plurality of first splines;

the female tapered surface of the recess is oriented to face away from the handle when the tiller assembly kit is assembled; and the handle is adapted for, when the tiller assembly kit is assembled, rotating the shaft in the pre-determined direction about the axis of rotation to thereby press the male tapered surface against the female tapered surface.

19. The tiller assembly kit of claim 16, wherein:

the recess is a first recess defined in a portion of the base, the first recess having a cylindrical portion and a female frusto-conical portion, the cylindrical portion and the female frusto-conical portion being coaxial with the axis of rotation and the female frusto-conical portion extending and narrowing from the cylindrical portion toward the handle when the tiller assembly kit is assembled;

the clamping fitting is a first clamping fitting, the first clamping fitting having a plurality of first splines disposed circumferentially about the axis of rotation when the tiller assembly kit is assembled;

the base defines a second recess in the portion of the base opposite the first recess, the second recess having a cylindrical portion and a female frusto-conical portion, the cylindrical portion and the female frusto-conical portion of the second recess being coaxial with the axis of rotation and the female frusto-conical portion of the second recess extending and narrowing from the cylindrical portion of the second recess toward the first recess when the tiller assembly kit is assembled;

the tiller assembly kit further includes a second clamping fitting, the second clamping fitting being for slidably engaging the shaft and comprising a male tapered surface and a plurality of second splines, the male tapered surface of the second clamping fitting being shaped to be received at least in part in the second recess when the tiller assembly kit is assembled; and the tiller arm defines:

a plurality of third splines for engaging the plurality of first splines of the first clamping fitting when the tiller assembly kit is assembled, and a plurality of fourth splines for engaging the plurality of second splines of the second clamping fitting when the tiller assembly kit is assembled.

20. The tiller assembly kit of claim 19, wherein:

the tiller arm defines a first arm at a rear end of the tiller arm, the first arm defining a first aperture coaxial with the axis of rotation when the tiller assembly kit is assembled, the first aperture comprising the plurality of third splines therein;

the tiller arm defines a second arm at the rear end of the tiller arm, the second arm defining a second aperture coaxial with the axis of rotation when the tiller assembly kit is assembled, the second aperture comprising the plurality of fourth splines therein;

the first and second clamping fittings are shaped to be received at least in part in respective ones of the first and second apertures so as to be slidable relative to the tiller arm along the axis of rotation and to be rotationally fixed relative to the tiller arm; and the portion of the base defining the first and second recesses therein is shaped to be received between the first arm and the second arm when the tiller assembly kit is assembled.

21. A tiller assembly for a marine outboard engine, comprising:

a base adapted to pivot relative to a steering axis of the marine outboard engine and defining an axis of rotation that is perpendicular to the steering axis;

a tiller arm pivotably connected to the base to pivot relative to the base about the axis of rotation for adjusting an angular position of the tiller arm relative to the base, one of the base and the tiller arm defining a male tapered surface, the male tapered surface being coaxial with the axis of rotation;

a shaft extending through the base and the tiller arm, the shaft being coaxial with the axis of rotation, the shaft having a first threaded portion;

a clamping fitting connected to the shaft, the clamping fitting defining a female tapered surface, the female tapered surface being coaxial with the axis of rotation, the female tapered surface contacting the male tapered surface, the clamping fitting being rotationally fixed relative to another one of the base and the tiller arm; and a handle, at least one of the handle and the clamping fitting having a second threaded portion engaged with the first threaded portion, wherein rotation of the first threaded portion relative to the second threaded portion in a pre-determined direction causes the female tapered surface of the clamping fitting to press against the male tapered surface.

* * * * *